US011488537B2

(12) United States Patent
Park et al.

(10) Patent No.: US 11,488,537 B2
(45) Date of Patent: Nov. 1, 2022

(54) DISPLAY DEVICE INCLUDING FIRST DOTS CONNECTED TO FIRST STAGES AND SECOND DOTS CONNECTED TO SECOND STAGES

(71) Applicant: SAMSUNG DISPLAY CO., LTD., Yongin-si (KR)

(72) Inventors: Se Hyuk Park, Yongin-si (KR); Hong Soo Kim, Yongin-si (KR); Jin Young Roh, Yongin-si (KR); Bong Hyun You, Yongin-si (KR); Hyo Jin Lee, Yongin-si (KR); Jae Keun Lim, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/182,825

(22) Filed: Feb. 23, 2021

(65) Prior Publication Data

US 2022/0036797 A1 Feb. 3, 2022

(30) Foreign Application Priority Data

Jul. 31, 2020 (KR) ..... 10-2020-0096230

(51) Int. Cl.
*G09G 3/3266* (2016.01)

(52) U.S. Cl.
CPC ... *G09G 3/3266* (2013.01); *G09G 2300/0452* (2013.01); *G09G 2310/0202* (2013.01);
(Continued)

(58) Field of Classification Search
CPC ..... G09G 3/3266; G09G 3/3674–3681; G09G 2300/0452; G09G 2310/0202;
(Continued)

(56) References Cited

U.S. PATENT DOCUMENTS 8,299,982 B2 * 10/2012 Chung ..... G11C 19/184 345/82
9,007,356 B2 * 4/2015 Chiang ..... G09G 3/3648 345/212

(Continued)

FOREIGN PATENT DOCUMENTS

KR 1020190003334 A 1/2019
KR 102070660 B1 1/2020

*Primary Examiner* — Gene W Lee
(74) *Attorney, Agent, or Firm* — Cantor Colburn LLP

(57) ABSTRACT

A display device includes first dots connected to first scan lines, second dots connected to second scan lines and alternately disposed with the first dots in a first direction and a second direction different from the first direction, a scan driver including first stages respectively connected to the first scan lines and second stages respectively connected to the second scan lines, and a data driver connected to the first dots and the second dots through data lines. The first stages are connected to first clock lines, the second stages are connected to second clock lines, first stages except a first start stage are respectively connected to corresponding first scan lines of corresponding previous first stages, and second stages except a second start stage are respectively connected to corresponding second scan lines of corresponding previous second stages.

20 Claims, 18 Drawing Sheets

(52) U.S. Cl.
CPC ..... *G09G 2310/0267* (2013.01); *G09G 2310/0286* (2013.01); *G09G 2310/08* (2013.01); *G09G 2320/0247* (2013.01)

(58) Field of Classification Search
CPC ... G09G 2310/0267; G09G 2310/0286; G09G 2320/0247
See application file for complete search history.

(56) References Cited

U.S. PATENT DOCUMENTS

| | | | | |
|---|---|---|---|---|
| 9,129,577 | B2 * | 9/2015 | Park | G09G 3/3677 |
| 9,311,871 | B2 * | 4/2016 | Kim | G09G 3/3614 |
| 9,824,643 | B2 * | 11/2017 | Jung | H01L 27/3218 |
| 10,504,442 | B2 | 12/2019 | Yoo | |
| 10,861,386 | B2 * | 12/2020 | Park | G09G 3/3275 |
| 2010/0123721 | A1 * | 5/2010 | Wong | G06T 11/203 345/469 |
| 2012/0120035 | A1 * | 5/2012 | Yang | G09G 3/3677 345/205 |
| 2013/0278572 | A1 | 10/2013 | Lee et al. | |
| 2015/0015590 | A1 * | 1/2015 | Jeong | G09G 3/2003 345/502 |
| 2015/0041790 | A1 * | 2/2015 | Lee | H01L 27/322 257/40 |
| 2018/0350300 | A1 * | 12/2018 | Park | G09G 3/3233 |
| 2021/0082346 | A1 * | 3/2021 | Park | G09G 3/3275 |

* cited by examiner

DISPLAY DEVICE INCLUDING FIRST DOTS CONNECTED TO FIRST STAGES AND SECOND DOTS CONNECTED TO SECOND STAGES

The application claims priority to Korean Patent Application No. 10-2020-0096230, filed on Jul. 31, 2020, and all the benefits accruing therefrom under 35 U.S.C. § 119, the content of which in its entirety is herein incorporated by reference.

BACKGROUND

1. Field

Embodiments of the invention relate to a display device.

2. Description of the Related Art

With a development of information technology, an importance of display devices, which are a connection medium between users and information, has been emphasized. In response to this, a use of display devices such as a liquid crystal display device, an organic light emitting display device, and the like is increasing.

When a display device displays a moving image, it may display an image at a high frequency in order to smoothly express a motion. In contrast, when the display device displays a still image, there is no motion, so even when the image is displayed at a low frequency, no problem may occur. Also, when the display device displays the image at the low frequency, it is advantageous in terms of power consumption.

SUMMARY

However, when a display frequency of a display device is switched from a high frequency to a low frequency, flicker may be visually recognized since a cycle in which the luminance decreases is changed. Also, when the display device is driven at the low frequency, flicker may occur when displaying a specific pattern.

A technical problem to be solved is to provide a display device capable of preventing visual recognition of flicker when a display frequency is switched from a high frequency to a low frequency.

In addition, a technical problem to be solved is to provide a display device capable of preventing flicker from occurring when a specific pattern is displayed during low frequency driving.

A display device in an embodiment of the invention includes first dots connected to first scan lines, second dots connected to second scan lines and alternately disposed with the first dots in a first direction and a second direction different from the first direction, a scan driver including a plurality of first stages respectively connected to the first scan lines and a plurality of second stages respectively connected to the second scan lines, and a data driver connected to the first dots and the second dots through data lines. The plurality of first stages is connected to first clock lines, the plurality of second stages is connected to second clock lines different from the first clock lines, first stages of the plurality of the first stages except a first start stage of the plurality of first stages are respectively connected to corresponding first scan lines of corresponding previous first stages among the plurality of first scan lines of the plurality of first stages, and second stages of the plurality of the second stages except a second start stage of the plurality of second stages are respectively connected to corresponding second scan lines of corresponding previous second stages among the plurality of second scan lines of the plurality of second stages.

In an embodiment, each of the first dots and the second dots may include a pixel of a first color, a pixel of a second color, and a pixel of a third color arranged in the first direction, and the first color, the second color, and the third color may be different from each other.

In an embodiment, each of the data lines may be connected to pixels of a single color.

In an embodiment, one first dot of the first dots may include a pixel of a first color, a pixel of a second color, a pixel of a third color, and a pixel of the second color arranged in the first direction. One second dot of the second dots disposed in the second direction from the one first dot of the first dots may include a pixel of the third color, a pixel of the second color, a pixel of the first color, and a pixel of the second color arranged in the first direction, and the first color, the second color, and the third color may be different from each other.

In an embodiment, one data line of the data lines may be alternately connected with the pixels of the first color and the third color, and another data line of the data lines may be connected to the pixels of the second color.

In an embodiment, the first start stage among the first stages and the second start stage among the second stages may be connected to a same scan start line.

In an embodiment, during each first frame period, the scan driver may alternately apply scan signals of a turn-on level to the first scan lines and the second scan lines.

In an embodiment, during a first sub-frame period among each second frame period, the scan driver may apply the scan signals of the turn-on level to the first scan lines, and maintain the scan signals of a turn-off level in the second scan lines. During a second sub-frame period among the each second frame period, the scan driver may apply the scan signals of the turn-on level to the second scan lines, and maintain the scan signals of the turn-off level in the first scan lines.

In an embodiment, the second frame period may be longer than the first frame period.

In an embodiment, during the first frame period, first clock signals of a turn-on level may be applied to the first clock lines, and second clock signals of the turn-on level may be applied to the second clock lines, and the first clock signals and the second clock signals may have different phases.

In an embodiment, during the first sub-frame period, the first clock signals of the turn-on level may be applied to the first clock lines, and the second clock signals of the turn-off level may be maintained in the second clock lines. During the second sub-frame period, the second clock signals of the turn-on level may be applied to the second clock lines, and the first clock signals of the turn-off level may be maintained in the first clock lines.

In an embodiment, in the first frame period and the first sub-frame period, cycles in which the first clock signals of the turn-on level are applied to the first clock lines may be identical to each other.

In an embodiment, in the first frame period and the second sub-frame period, cycles in which the second clock signals of the turn-on level are applied to the second clock lines may be identical to each other.

In an embodiment, in the first frame period and the first sub-frame period, cycles in which first scan signals of the turn-on level are applied to the first scan lines may be identical to each other.

In an embodiment, in the first frame period and the second sub-frame period, cycles in which second scan signals of the turn-on level are applied to the second scan lines may be identical to each other.

In an embodiment, a cycle in which the first clock signals of the turn-on level are applied to the first clock lines in the first sub-frame period may be shorter than a cycle in which the first clock signals of the turn-on level are applied in the first frame period.

In an embodiment, a cycle in which second clock signals of the turn-on level are applied to the second clock lines in the second sub-frame period may be shorter than a cycle in which the second clock signals of the turn-on level are applied in the first frame period.

In an embodiment, a cycle in which first scan signals of the turn-on level are applied to the first scan lines in the first sub-frame period may be shorter than a cycle in which the first scan signals of the turn-on level are applied in the first frame period.

In an embodiment, a cycle in which the second scan signals of the turn-on level are applied to the second scan lines in the second sub-frame period may be shorter than a cycle in which the second scan signals of the turn-on level are applied in the first frame period.

In an embodiment, during at least some of the first sub-frame period and the second sub-frame period, the data driver may be powered off.

BRIEF DESCRIPTION OF THE DRAWINGS

The accompanying drawings, which are included to provide a further understanding of the inventions, and are incorporated in and constitute a part of this specification, illustrate embodiments of the inventions, and, together with the description, serve to explain principles of the inventions.

DETAILED DESCRIPTION

Figure 1:
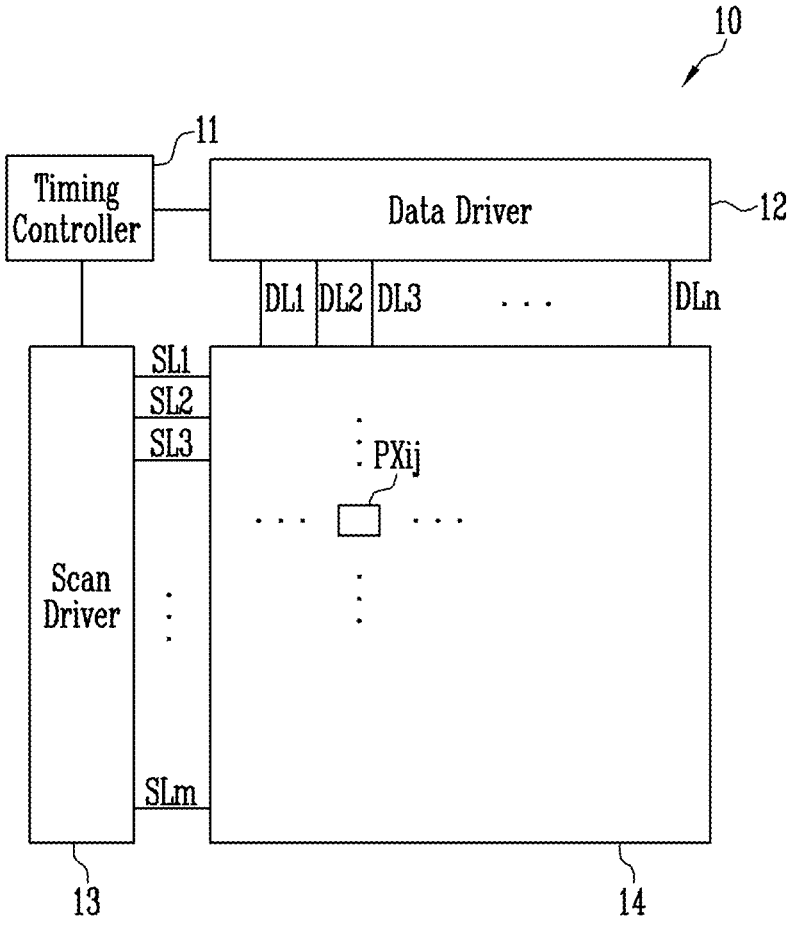
FIG. 1 is a diagram for explaining an embodiment of a display device according to the invention.

Hereinafter, embodiments of the invention will be described in detail with reference to the accompanying drawings so that those skilled in the art may easily implement the invention. Embodiments of the invention may be embodied in various different forms and is not limited to the embodiments described herein.

In order to clearly describe the invention, parts that are not related to the description are omitted, and the same or similar components are denoted by the same reference numerals throughout the specification. Therefore, the above-mentioned reference numerals can be used in other drawings.

In addition, the size and thickness of each component shown in the drawings are arbitrarily shown for convenience of description, and thus the invention is not necessarily limited to those shown in the drawings. In the drawings, thicknesses may be exaggerated to clearly express the layers and regions.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a diagram for explaining an embodiment of a display device according to the invention.

Referring to FIG. 1, a display device 10 in an embodiment of the invention may include a timing controller 11, a data driver 12, a scan driver 13, and a pixel unit 14.

The timing controller 11 may receive an external input signal from an external processor. The external input signal may include a vertical synchronization signal, a horizontal synchronization signal, a data enable signal, RGB data, and the like. The vertical synchronization signal may include a plurality of pulses. Based on a time point at which each pulse occurs, the end of a previous frame period and the start of a current frame period may be indicated. An interval between adjacent pulses of the vertical synchronization signal may correspond to one frame period. The horizontal synchronization signal may include a plurality of pulses. Based on a time point at which each pulse occurs, the end of a previous horizontal period and the start of a new horizontal period may be indicated. An interval between adjacent pulses of the horizontal synchronization signal may correspond to one horizontal period. The data enable signal may indicate that the RGB data is supplied in a horizontal period. The RGB data may be supplied in units of pixel rows in horizontal periods in response to the data enable signal. The RGB data corresponding to one frame may be also referred to as one input image. The timing controller 11 may determine the consecutive input images as a still image when grayscales of the consecutive input images are substantially the same. The timing controller 11 may determine the consecutive input images as a moving image when grayscales of the consecutive input images are substantially different.

The data driver 12 may provide data voltages corresponding to the grayscales of the input image to pixels. In an embodiment, the data driver 12 may sample the grayscales using a clock signal and apply the data voltages corresponding to the grayscales to data lines DL1 to DLn in units of scan lines, where n may be an integer greater than 0, for example.

The scan driver 13 may receive a clock signal, a scan start signal, and the like from the timing controller 11 and generate scan signals to be provided to scan lines SL1, SL2, SL3, and SLm, where m may be an integer greater than 0.

The pixel unit 14 may include dots. Each dot may include at least two pixels of different colors. A dot may be a display unit for displaying a combined color. In an embodiment, the external processor may provide the grayscales in units of dots, for example. Each pixel PXij may be connected to a corresponding data line and a corresponding scan line, where i and j may be integers greater than 0. In an embodiment, the pixel PXij may mean a pixel in which a scan transistor is connected to an i-th scan line and a j-th data line, for example.

Although not shown, the display device 10 may further include an emission driver. The emission driver may receive a clock signal, an emission stop signal, and the like from the timing controller 11 and generate emission signals to be provided to emission lines. In an embodiment, the emission driver may include emission stages connected to the emission lines, for example. The emission stages may be configured in the form of a shift register. In an embodiment, a first emission stage may generate an emission signal of a turn-off level based on the emission stop signal of a turn-off level, and the remaining emission stages may sequentially generate the emission signals of the turn-off level based on the emission signal of the turn-off level of a previous emission stage, for example.

When the display device 10 includes the aforementioned emission driver, each pixel PXij may further include a transistor connected to an emission line. Such a transistor may be turned off during a data write period of each pixel PXij to prevent light emitting of the pixel PXij. Hereinafter, a case where the emission driver is not included will be described as an example.

Figure 2:
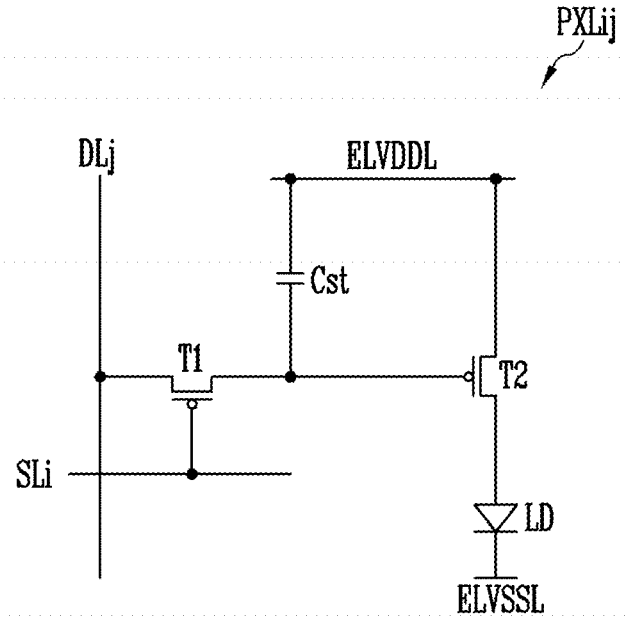
FIG. 2 is a diagram for explaining an embodiment of a pixel according to the invention.

FIG. 2 is a diagram for explaining an embodiment of a pixel according to the invention.

A first transistor T1 may include a gate electrode connected to an i-th scan line SLi, a first electrode connected to a j-th data line DLj, and a second electrode connected to a second electrode of a storage capacitor Cst. The first transistor T1 may be also referred to as a scan transistor.

A second transistor T2 may include a gate electrode connected to the second electrode of the first transistor T1, a first electrode connected to a first power line ELVDDL, and a second electrode connected to an anode of a light emitting diode LD. The second transistor T2 may be also referred to as a driving transistor.

The storage capacitor Cst may include a first electrode connected to the first power line ELVDDL and the second electrode connected to the gate electrode of the second transistor T2.

The light emitting diode LD may include the anode connected to the second electrode of the second transistor T2 and a cathode connected to a second power line ELVSSL. During an emission period of the light emitting diode LD, a first power voltage applied to the first power line ELVDDL may be greater than a second power voltage applied to the second power line ELVSSL.

Here, the transistors T1 and T2 are shown as p-type transistors. However, those skilled in the art may replace at least one transistor with an n-type transistor by inverting the phase of a signal.

When a scan signal of a turn-on level (here, a logic low level) is applied through the i-th scan line SLi, the first transistor T1 may be turned on. At this time, a data voltage applied to the j-th data line DLj may be stored in the storage capacitor Cst.

A driving current corresponding to a voltage difference between the first electrode and the second electrode of the storage capacitor Cst may flow between the first electrode and the second electrode of the second transistor T2. Accordingly, the light emitting diode LD may emit light with a luminance corresponding to the data voltage.

Next, when the scan signal of a turn-off level (here, a logic high level) is applied through the i-th scan line SLi, the first transistor T1 may be turned off, and the j-th data line DLj and the second electrode of the storage capacitor Cst may be electrically separated. Accordingly, even when the data voltage of the j-th data line DLj is changed, a voltage stored in the second electrode of the storage capacitor Cst may not be changed.

Embodiments of the invention may be applied not only to the pixel PXij of FIG. 2, but also to a pixel having another pixel circuit according to the prior art.

Figure 3:
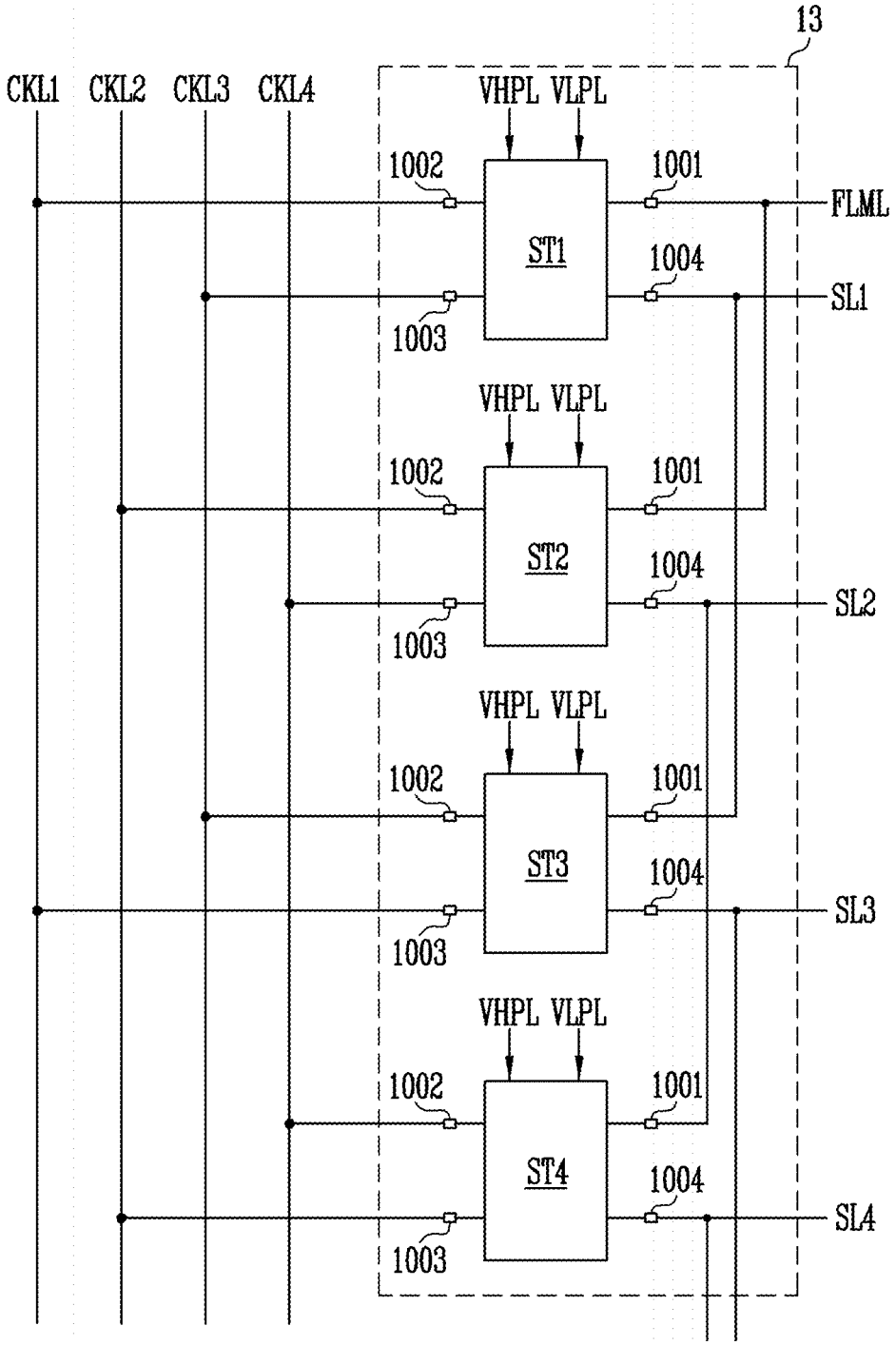
FIG. 3 is a diagram for explaining an embodiment of a scan driver according to the invention.

FIG. 3 is a diagram for explaining an embodiment of a scan driver according to the invention.

The scan driver 13 may include first stages ST1, ST3, . . . connected to first scan lines SL1, SL3, . . . , and second stages ST2, ST4, . . . connected to second scan lines SL2, SL4, . . . .

The first scan lines SL1, SL3, . . . may be connected to first dots. In an embodiment, the first scan lines SL1, SL3, . . . may be odd-numbered scan lines, for example. In an embodiment, the first stages ST1, ST3, . . . may be odd-numbered stages, for example.

The second scan lines SL2, SL4, . . . may be connected to second dots. In an embodiment, the second scan lines SL2, SL4, . . . may be even-numbered scan lines, for example. In an embodiment, the second stages ST2, ST4, . . . may be even-numbered stages, for example.

Each of the stages ST1 to ST4 may include a first input terminal 1001, a second input terminal 1002, a third input terminal 1003, and an output terminal 1004. A first start stage ST1 among the first stages ST1, ST3, . . . and a second start stage ST2 among the second stages ST2, ST4, . . . may be connected to the same scan start line FLML. In an embodiment, the first input terminal 1001 of the first start stage ST1 and the first input terminal 1001 of the second start stage ST2 may be connected to the same scan start line FLML, for example. The output terminal 1004 of the first start stage ST1 may be connected to a first scan line SL1, and the output terminal 1004 of the second start stage ST2 may be connected to a second scan line SL2.

Each of the first stages ST3, . . . except the first start stage ST1 may be connected to the first scan line of a previous first stage. Each of the second stages ST4, . . . except the second start stage ST2 may be connected to the second scan line of a previous second stage. In an embodiment, the first input terminal 1001 of a first stage ST3 may be connected to the first scan line SL1 of the first start stage ST1, for example. Also, the first input terminal 1001 of a second stage ST4 may be connected to the second scan line SL2 of the second start stage ST2.

The first stages ST1, ST3, . . . may be connected to first clock lines CKL1 and CKL3. The first clock lines CKL1 and CKL3 may be alternately connected to the second input terminal 1002 and the third input terminal 1003 of the first stages ST1, ST3, . . . . The second stages ST2, ST4, . . . may be connected to second clock lines CKL2 and CKL4 different from the first clock lines CKL1 and CKL3. The second clock lines CKL2 and CKL4 may be alternately connected to the second input terminal 1002 and the third input terminal 1003 of the second stages ST2, ST4, . . . .

Each of the stages ST1 to ST4 may be connected to a power line VHPL and a power line VLPL. Here, a voltage of the power line VHPL may be set to a turn-off level (a gate-off voltage, the logic high level). In addition, a voltage of the power line VLPL may be set to a turn-on level (a gate-on voltage, the logic low level).

In the embodiment of FIG. 3, the first start stage ST1 and the second start stage ST2 may be connected to the same scan start line FLML. However, in another embodiment, the first start stage ST1 and the second start stage ST2 may be connected to different scan start lines.

Figure 4:
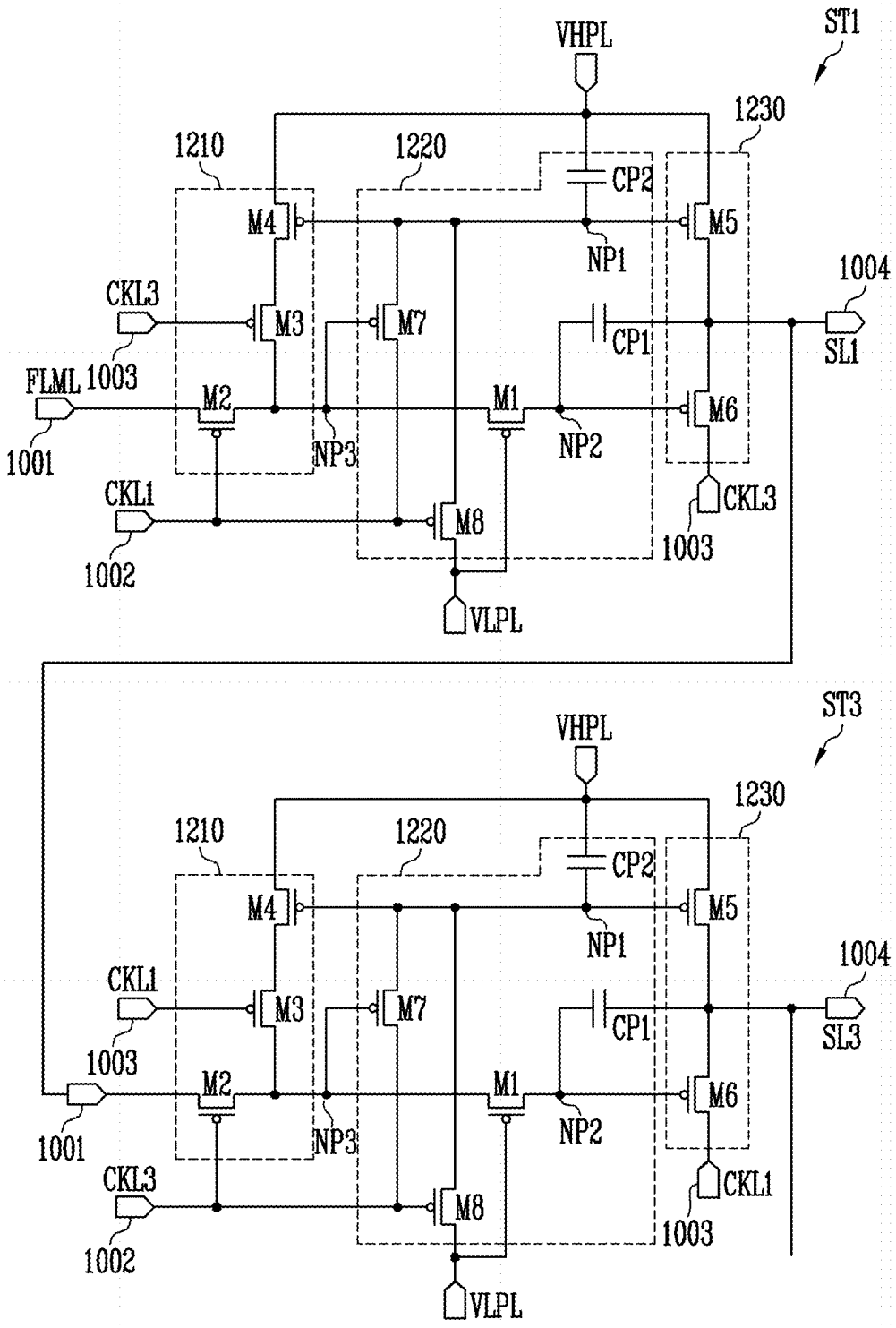
FIG. 4 is a diagram for explaining an embodiment of a stage according to the invention.

FIG. 4 is a diagram for explaining an embodiment of a stage according to the invention.

In FIG. 4, for convenience of description, the first start stage ST1 and the first stage ST3 are shown as an example. Referring to FIG. 4, the first start stage ST1 may include a first driving unit 1210, a second driving unit 1220, and an output unit (e.g., a buffer) 1230.

The output unit 1230 may control a voltage supplied to the output terminal 1004 in response to voltages of a node NP1 and a node NP2. To this end, the output unit 1230 may include a transistor M5 and a transistor M6.

The transistor M5 may be disposed between the power line VHPL and the output terminal 1004, and a gate electrode of the transistor M5 may be connected to the node NP1. The transistor M5 may control the connection between the power line VHPL and the output terminal 1004 in response to a voltage applied to the node NP1.

The transistor M6 may be disposed between the output terminal 1004 and the third input terminal 1003, and a gate electrode of the transistor M6 may be connected to the node NP2. The transistor M6 may control the connection between the output terminal 1004 and the third input terminal 1003 in response to a voltage applied to the node NP2. The output unit 1230 may be driven as a buffer. Additionally, the transistor M5 and the transistor M6 may include a plurality of transistors connected in parallel.

The first driving unit 1210 may control a voltage of a node NP3 in response to signals supplied to the first to third input terminals 1001 to 1003. To this end, the first driving unit 1210 may include transistors M2 to M4.

A transistor M2 may be disposed between the first input terminal 1001 and the node NP3, and a gate electrode of the transistor M2 may be connected to the second input terminal 1002. The transistor M2 may control the connection between the first input terminal 1001 and the node NP3 in response to a signal supplied to the second input terminal 1002.

A transistor M3 and a transistor M4 may be connected in series between the node NP3 and the power line VHPL. The transistor M3 may be disposed between the transistor M4 and the node NP3, and a gate electrode of the transistor M3 may be connected to the third input terminal 1003. The transistor M3 may control the connection between the transistor M4 and the node NP3 in response to a signal supplied to the third input terminal 1003.

The transistor M4 may be disposed between the transistor M3 and the power line VHPL, and a gate electrode of the transistor M4 may be connected to the node NP1. The transistor M4 may control the connection between the transistor M3 and the power line VHPL in response to a voltage of the node NP1.

The second driving unit 1220 may control the voltage of the node NP1 in response to voltages of the second input terminal 1002 and the node NP3. To this end, the second driving unit 1220 may include a transistor M1, a transistor M7, a transistor M8, a capacitor CP1, and a capacitor CP2.

The capacitor CP1 may be connected between the node NP2 and the output terminal 1004. The capacitor CP1 may be charged with a voltage corresponding to turn-on and turn-off of the transistor M6.

The capacitor CP2 may be connected between the node NP1 and the power line VHPL. The capacitor CP2 may be charged with the voltage applied to the node NP1.

The transistor M7 may be disposed between the node NP1 and the second input terminal 1002, and a gate electrode of the transistor M7 may be connected to the node NP3. The transistor M7 may control the connection between the node NP1 and the second input terminal 1002 in response to a voltage of the node NP3.

The transistor M8 may be disposed between the node NP1 and the power line VLPL, and a gate electrode of the transistor M8 may be connected to the second input terminal 1002. The transistor M8 may control the connection between the node NP1 and the power line VLPL in response to a signal of the second input terminal 1002.

The transistor M1 may be disposed between the node NP3 and the node NP2, and a gate electrode of the transistor M1 may be connected to the power line VLPL. The transistor M1 may maintain the electrical connection between the node NP3 and the node NP2 while maintaining a turned-on state. Additionally, the transistor M1 may limit the drop width of the voltage of the node NP3 in response to a voltage of the node NP2. In other words, even when the voltage of the node NP2 falls to a voltage lower than the voltage of the power line VLPL, the voltage of the node NP3 may not be lower than a voltage obtained by subtracting a threshold voltage of the transistor M1 from the voltage of the power line VLPL.

Figure 5:
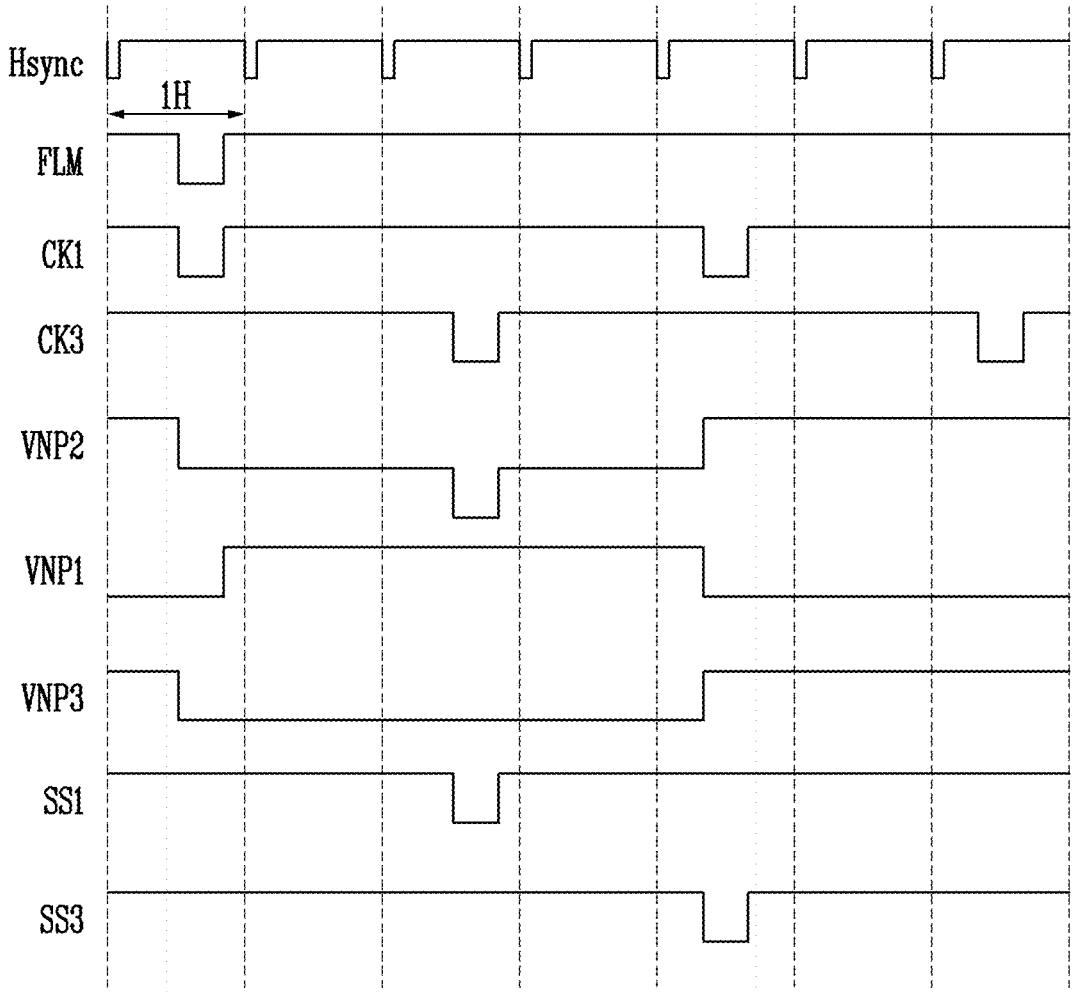
FIG. 5 is a diagram for explaining an embodiment of a driving method of the scan driver according to the invention.

FIG. 5 is a diagram for explaining an embodiment of a driving method of the scan driver according to the invention. In FIG. 5, for convenience of description, an operation process using the first start stage ST1 will be described as an example.

Referring to FIG. 5, a first clock signal CK1 and a first clock signal CK3 may have a cycle of four horizontal periods 4H, and may be supplied in different horizontal periods. In other words, the first clock signal CK3 may be set as a signal shifted by a half cycle (that is, two horizontal periods) from the first clock signal CK1. In addition, a scan start signal FLM supplied to the first input terminal 1001 may be supplied in synchronization with the first clock signal CK1 supplied to the second input terminal 1002. One horizontal cycle 1H may correspond to a cycle of pulses of the horizontal synchronization signal Hsync.

Hereinafter, "predetermined signals are supplied" may mean that the predetermined signals have a turn-on level (here, the logic low level). "The supply of predetermined signals is stopped" may mean that the predetermined signals have a turn-off level (here, the logic high level).

Additionally, when the scan start signal FLM is supplied, the first input terminal 1001 may be set to a voltage of the logic low level, and when the scan start signal FLM is not supplied, the first input terminal 1001 may be set to a voltage of the logic high level. In addition, when a clock signal is supplied to the second input terminal 1002 and the third input terminal 1003, the second input terminal 1002 and the third input terminal 1003 may be set to the voltage of the logic low level, and when the clock signal is not supplied, the second input terminal 1002 and the third input terminal 1003 may be set to the voltage of the logic high level.

To describe the operation process in detail, first, the scan start signal FLM may be supplied in synchronization with the first clock signal CK1.

When the first clock signal CK1 is supplied, the transistor M2 and the transistor M8 may be turned on. When the transistor M2 is turned on, the first input terminal 1001 and the node NP3 may be electrically connected. Here, since the transistor M1 is set to be turned on in most of the period, the node NP2 may maintain the electrical connection with the node NP3.

When the first input terminal 1001 and the node NP3 are electrically connected, a voltage VNP2 of the node NP2 and a voltage VNP3 of the node NP3 may be set to a low level by the scan start signal FLM supplied to the first input terminal 1001. When the voltage VNP2 of the node NP2 and the voltage VNP3 of the node NP3 are set to the low level, the transistor M6 and the transistor M7 may be turned on.

When the transistor M6 is turned on, the third input terminal 1003 and the output terminal 1004 may be electrically connected. Here, the third input terminal 1003 may be set to a voltage of a high level (that is, the first clock signal CK3 is not supplied), and accordingly, the voltage of the high level may be output to the output terminal 1004. When the transistor M7 is turned on, the second input terminal 1002 and the node NP1 may be electrically connected. According to the first clock signal CK1 supplied to the second input terminal 1002, a voltage VNP1 of the node NP1 may be set to the low level.

Additionally, when the first clock signal CK1 is supplied, the transistor M8 may be turned on. When the transistor M8 is turned on, the voltage of the power line VLPL may be supplied to the node NP1. Here, the voltage of the power line VLPL may be set to the same (or similar) voltage as the low level of the first clock signal CK1, and accordingly, the node NP1 may stably maintain the voltage of the low level.

When the node NP1 is set to the voltage of the low level, the transistor M4 and the transistor M5 may be turned on. When the transistor M4 is turned on, the power line VHPL and the transistor M3 may be electrically connected. Here, since the transistor M3 is set in a turned-off state, the node NP3 may stably maintain the voltage of the low level even when the transistor M4 is turned on. When the transistor M5 is turned on, the voltage of the power line VHPL may be supplied to the output terminal 1004. Here, the voltage of the power line VHPL may be set to the same (or similar) voltage as the voltage of the high level supplied to the third input terminal 1003, and accordingly, the output terminal 1004 may stably maintain the voltage of the high level.

Thereafter, the supply of the scan start signal FLM and the first clock signal CK1 may be stopped. When the supply of the first clock signal CK1 is stopped, the transistor M2 and the transistor M8 may be turned off. At this time, the transistor M6 and the transistor M7 may maintain the turned-on state in response to the voltage stored in the capacitor CP1. That is, the node NP2 and the node NP3 may maintain the voltage of the low level by the voltage stored in the capacitor CP1.

When the transistor M6 maintains the turned-on state, the output terminal 1004 and the third input terminal 1003 may maintain the electrical connection. When the transistor M7 maintains the turned-on state, the node NP1 may maintain the electrical connection with the second input terminal 1002. Here, a voltage of the second input terminal 1002 may be set to the voltage of the high level as the supply of the first clock signal CK1 is stopped, and accordingly, the node NP1 may also be set to the voltage of the high level. When the voltage of the high level is supplied to the node NP1, the transistor M4 and the transistor M5 may be turned off.

Thereafter, the first clock signal CK3 may be supplied to the third input terminal 1003. At this time, since the transistor M6 is set to the turned-on state, the first clock signal CK3 supplied to the third input terminal 1003 may be supplied to the output terminal 1004. In this case, the output terminal 1004 may output the first clock signal CK3 as a scan signal SS1 of the turn-on level to the first scan line SL1.

When the first clock signal CK3 is supplied to the output terminal 1004, the voltage of the node NP2 may be lowered to a voltage lower than the voltage of the power line VLPL due to the coupling of the capacitor CP1. Accordingly, the transistor M6 may stably maintain the turned-on state.

Even when the voltage of the node NP2 is lowered, the node NP3 may approximately maintain the voltage of the power line VLPL (for example, the voltage obtained by subtracting the threshold voltage of the transistor M1 from the voltage of the power line VLPL) by the transistor M1.

After a first scan signal SS1 of the turn-on level is output to the first scan line SL1, the supply of the first clock signal CK3 may be stopped. When the supply of the first clock signal CK3 is stopped, the output terminal 1004 may output the voltage of the high level. In addition, a voltage VNP2 of the node NP2 may approximately rise to the voltage of the power line VLPL in response to the voltage of the high level of the output terminal 1004.

Thereafter, the first clock signal CK1 may be supplied. When the first clock signal CK1 is supplied, the transistor M2 and the transistor M8 may be turned on. When the transistor M2 is turned on, the first input terminal 1001 and the node NP3 may be electrically connected. At this time, the scan start signal FLM may not be supplied to the first input terminal 1001, and accordingly, the node NP3 may be set to the voltage of the high level. Accordingly, the voltage of the high level may be supplied to the node NP3 and the node NP2, and accordingly, the transistor M6 and the transistor M7 may be turned off.

When the transistor M8 is turned on, the voltage of the power line VLPL may be supplied to the node NP1, and accordingly, the transistor M4 and the transistor M5 may be turned on. When the transistor M5 is turned on, the voltage of the power line VHPL may be supplied to the output terminal 1004. Thereafter, the transistor M4 and the transistor M5 may maintain the turned-on state in response to the voltage charged in the capacitor CP2, and accordingly, the output terminal 1004 may stably receive the voltage of the power line VHPL.

Additionally, when the first clock signal CK3 is supplied, the transistor M3 may be turned on. At this time, since the transistor M4 is set to the turned-on state, the voltage of the power line VHPL may be supplied to the node NP3 and the node NP2. In this case, the transistor M6 and the transistor M7 may stably maintain the turned-off state.

The first stage ST3 may receive an output signal (that is, the scan signal) of the first stage ST1 so as to be synchronized with the first clock signal CK3. In this case, the first stage ST3 may output a first scan signal SS3 of the turn-on level to a first scan line SL3 to be synchronized with the first clock signal CK1. The first stages ST1, ST3, . . . may sequentially output the scan signal of the turn-on level to the first scan lines SL1, SL3, . . . while repeating the above-described process.

The descriptions of the first stages ST1, ST3, . . . shown in FIGS. 4 and 5 may be applied substantially equally to the second stages ST2, ST4, . . . . The stages of FIGS. 4 and 5 and the driving method thereof are an example, and other conventional stages and driving methods may be used to configure the embodiments of the invention.

FIGS. 6 to 9 are diagrams for explaining an embodiment of a first frame period and a second frame period according to the invention.

Figure 6:
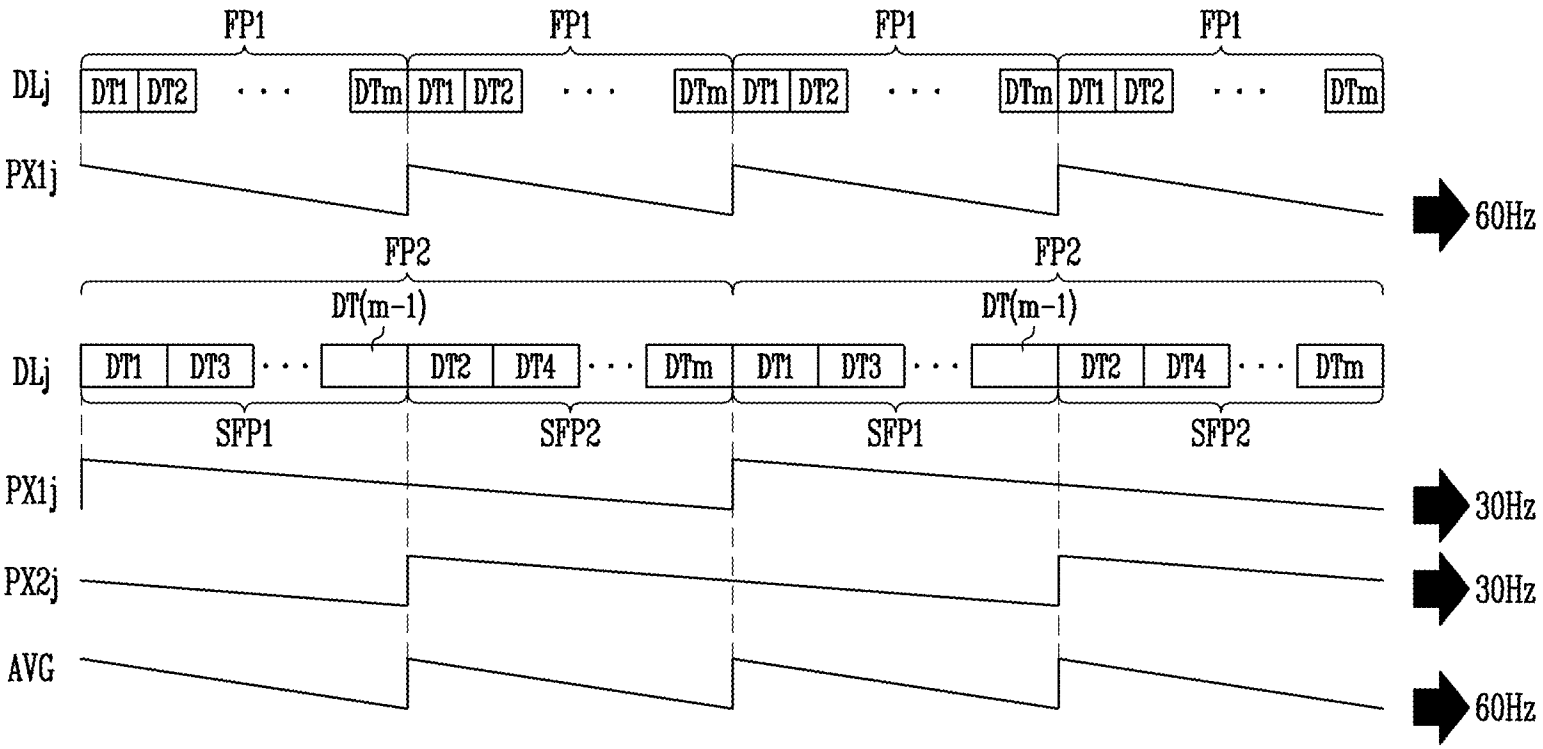
FIGS. 6 to 9 are diagrams for explaining an embodiment of a first frame period and a second frame period according to the invention.

The display device 10 may operate in a first display mode including a plurality of first frame periods FP1 or may operate in a second display mode including a plurality of second frame periods FP2. The second frame periods FP2 may be longer than the first frame periods FP1. In an embodiment, a second frame period FP2 may be an integer multiple of a first frame period FP1, for example. In an embodiment, the second frame period FP2 may be 2p times the first frame period FP1, where p may be an integer greater than 0, for example. In the embodiment of FIG. 6, the second frame period FP2 may be twice the first frame period FP1.

The first display mode may be suitable for displaying a moving image by displaying input images (frames) at a high frequency. The second display mode may be suitable for displaying a still image by displaying the input images at a low frequency. When the still image is detected while displaying the moving image, the display device 10 may switch from the first display mode to the second display mode. Also, when the moving image is detected while displaying the still image, the display device 10 may switch from the second display mode to the first display mode.

Referring to FIG. 6, for convenience of description, descriptions will be made based on the j-th data line DLj and pixels PX1*j* and PX2*j*. In an embodiment, a first pixel PX1*j* may be connected to the j-th data line and the first scan line SL1. The first pixel PX1*j* may belong to a first dot. In an embodiment, a second pixel PX2*j* may be connected to the j-th data line and the second scan line SL2. The second pixel PX2*j* may belong to a second dot.

In each first frame period FP1, the data driver 12 may sequentially apply the data voltages corresponding to the scan lines to the data lines. In an embodiment, the data driver 12 may sequentially apply data voltages DT1, DT2, . . . DT(m−1), and DTm to the j-th data line DLj, for example. Assuming that the first frame period FP1 is 1/60 second, a first data voltage DT1 may be supplied to the first pixel PX1*j* at a frequency of 60 hertz (Hz). Accordingly, the first pixel PX1*j* may emit light with the highest luminance at a time point at which the first data voltage DT1 is applied, and then the luminance may gradually decrease due to a leakage current. Referring to FIG. 6, a waveform of the luminance of the first pixel PX1*j* corresponding to the plurality of first frame periods FP1 is shown as an example.

Each second frame period FP2 may include a first sub-frame period SFP1 and a second sub-frame period SFP2. The lengths of the first sub-frame period SFP1 and the second sub-frame period SFP2 may be the same. In an embodiment, assuming that the second frame period FP2 is 1/30 second, each of the first sub-frame period SFP1 and the second sub-frame period SFP2 may be 1/60 second, for example.

In each first sub-frame period SFP1, the data driver 12 may sequentially apply the data voltages corresponding to the first dots to the data lines. In an embodiment, the data driver 12 may sequentially apply the data voltages DT1, DT3, . . . , and DT(m−1) to the j-th data line DLj, for example. In each second sub-frame period SFP2, the data driver 12 may sequentially apply the data voltages corresponding to the second dots to the data lines. In an embodiment, the data driver 12 may sequentially apply the data voltages DT2, DT4, . . . , and DTm to the j-th data line DLj, for example.

Accordingly, the first data voltage DT1 may be supplied to the first pixel PX1*j* at a frequency of 30 Hz. Therefore, the first pixel PX1*j* may emit light with the highest luminance at the time point at which the first data voltage DT1 is applied, and then the luminance may gradually decrease due to the leakage current. Referring to FIG. 6, a waveform of the luminance of the first pixel PX1*j* corresponding to the plurality of second frame periods FP2 is shown as an example. In addition, a second data voltage DT2 may be applied to the second pixel PX2*j* at a frequency of 30 Hz. Accordingly, the second pixel PX2*j* may emit light with the highest luminance at a time point at which the second data voltage DT2 is applied, and then the luminance may gradually decrease due to the leakage current. Referring to FIG. 6, a waveform of the luminance of the second pixel PX2*j* corresponding to the plurality of second frame periods FP2 is shown as an example.

In this case, since the first pixel PX1*j* and the second pixel PX2*j* are disposed adjacent to each other, the first data voltage DT1 and the second data voltage DT2 may be generally the same or similar in a general input image.

Since a time point at which the first pixel PX1*j* has the highest luminance and a time point at which the second pixel PX2*j* has the highest luminance are alternately disposed, a user may recognize a frequency of a waveform AVG of an average luminance of the first pixel PX1*j* and the second pixel PX2*j* as 60 Hz. Accordingly, even when the first display mode and the second display mode are switched, visual recognition of flicker due to a difference in waveforms of the luminance may be prevented.

Figure 7:
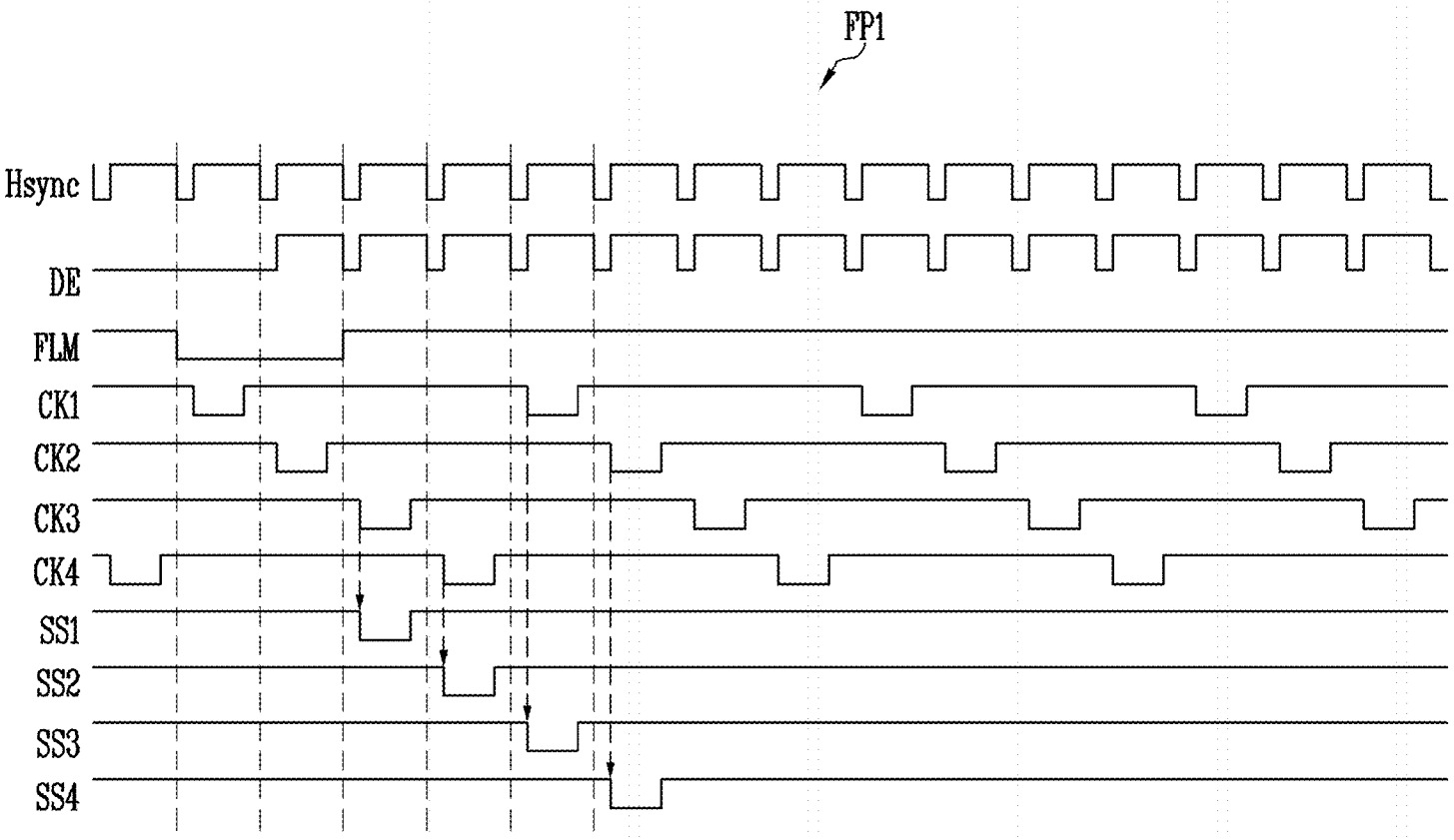

Referring to FIG. 7, control signals in the first frame period FP1 are shown as an example.

During the first frame period FP1, the timing controller 11 may apply first clock signals CK1 and CK3 of a turn-on level to the first clock lines CKL1 and CKL3, and may apply second clock signals CK2 and CK4 of the turn-on level to the second clock lines CKL2 and CKL4. The first clock signals CK1 and CK3 and the second clock signals CK2 and CK4 may have different phases. In an embodiment, the clock signals CK1, CK2, CK3, and CK4 of the turn-on level may be sequentially supplied in the order of a first clock line CKL1, a second clock line CKL2, a first clock line CKL3, and a second clock line CKL4, for example. In an embodiment, a cycle of each of the clock signals CK1, CK2, CK3, and CK4 of the turn-on level may be four horizontal cycles 4H, for example.

Also, the timing controller 11 may apply the scan start signal FLM of a turn-on level to the scan start line FLML. In this case, the length of the scan start signal FLM of the turn-on level may be set to overlap with the first clock signal CK1 of the turn-on level and a second clock signal CK2 of the turn-on level. In an embodiment, the length of the scan start signal FLM of the turn-on level may be two horizontal cycles 2H, for example.

During the first frame period FP1, the scan driver 13 may alternately apply scan signals SS1, SS2, SS3, SS4, . . . of the turn-on level to the first scan lines SL1, SL3, . . . and the second scan lines SL2, SL4, . . . .

Referring to the driving method of FIG. 5, the first scan signal SS1 of the turn-on level may be generated in response to the first clock signal CK3 of the turn-on level. In addition, a second scan signal SS2 of the turn-on level may be generated in response to a second clock signal CK4 of the turn-on level. Similarly, the first scan signal SS3 of the turn-on level may be generated in response to the first clock signal CK1 of the turn-on level. In addition, a second scan signal SS4 of the turn-on level may be generated in response to the second clock signal CK2 of the turn-on level.

The data driver 12 may supply the data voltages to be synchronized with each of the scan signals SS1, SS2, SS3, SS4, . . . of the turn-on level. In an embodiment, the data driver 12 may supply the data voltages in a current horizontal period in response to grayscales latched by a data enable signal DE of the logic high level in a previous horizontal period, for example.

Figure 8:
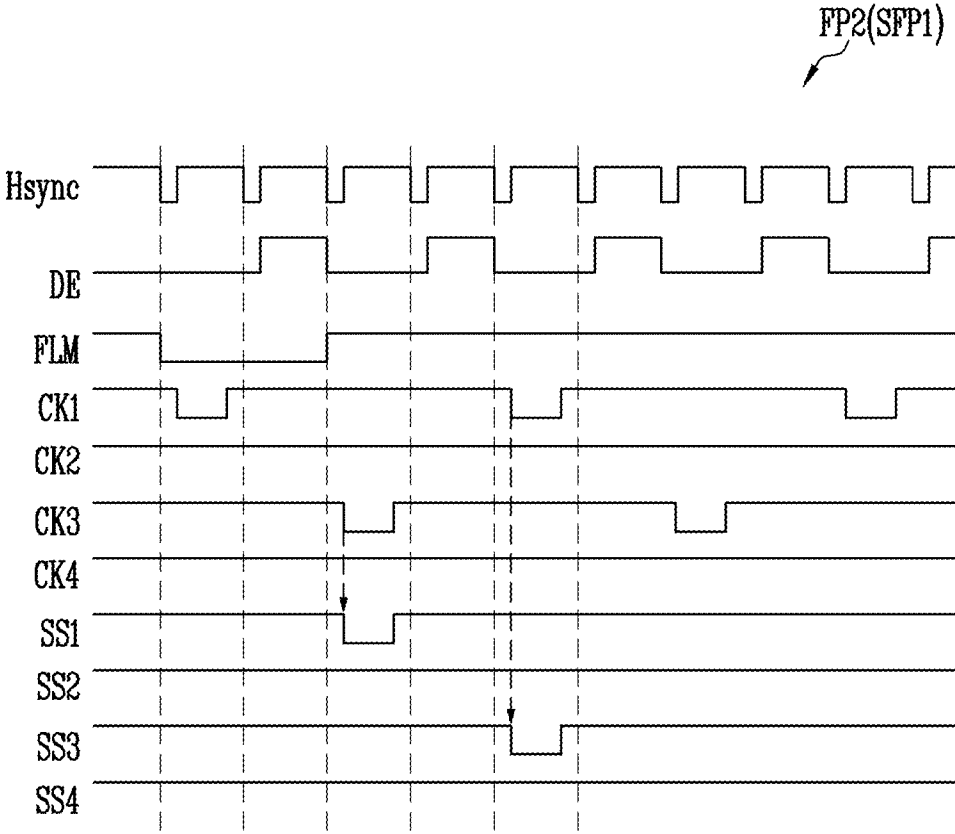

Referring to FIG. 8, control signals in the first sub-frame period SFP1 among the second frame period FP2 are shown as an example.

During the first sub-frame period SFP1, the timing controller 11 may apply the first clock signals CK1 and CK3 of the turn-on level to the first clock lines CKL1 and CKL3, and maintain the second clock signals CK2 and CK4 of a turn-off level in the second clock lines CKL2 and CKL4. In the first frame period FP1 and the first sub-frame period SFP1, cycles in which the first clock signals CK1 and CK3 of the turn-on level are applied to the first clock lines CKL1 and CKL3 may be the same. In an embodiment, a cycle of each of the first clock signals CK1 and CK3 of the turn-on level may be four horizontal cycles 4H, for example.

In addition, the timing controller 11 may apply the scan start signal FLM of the turn-on level to the scan start line FLML. In this case, the length of the scan start signal FLM of the turn-on level may be set to overlap with the first clock signal CK1 of the turn-on level. In an embodiment, the length of the scan start signal FLM of the turn-on level may be two horizontal cycles 2H as shown, but may be set to one horizontal cycle 1H, for example.

During the first sub-frame period SFP1, the scan driver 13 may apply the scan signals SS1, SS3, . . . of the turn-on level to the first scan lines SL1, SL3, . . . , and maintain the scan signals SS2, SS4, . . . of the turn-off level in the second scan lines SL2, SL4, In the first frame period FP1 and the first sub-frame period SFP1, cycles in which the first scan signals SS1, SS3, . . . of the turn-on level are applied to the first scan lines SS1, SS3, . . . may be the same.

The data driver 12 may supply the data voltages to be synchronized with each of the first scan signals SS1, SS3, . . . of the turn-on level. In this case, since the data voltages do not need to be supplied to be synchronized with the second scan signals SS2, SS4, . . . , a cycle of the data enable signal DE of the turn-on level in the first sub-frame period SFP1 may be longer than a cycle of the data enable signal DE of the turn-on level in the first frame period FP1. Accordingly, since a cycle in which the data driver 12 changes the data voltages increases, there is an advantage that the dynamic power of the data driver 12 decreases.

Figure 9:
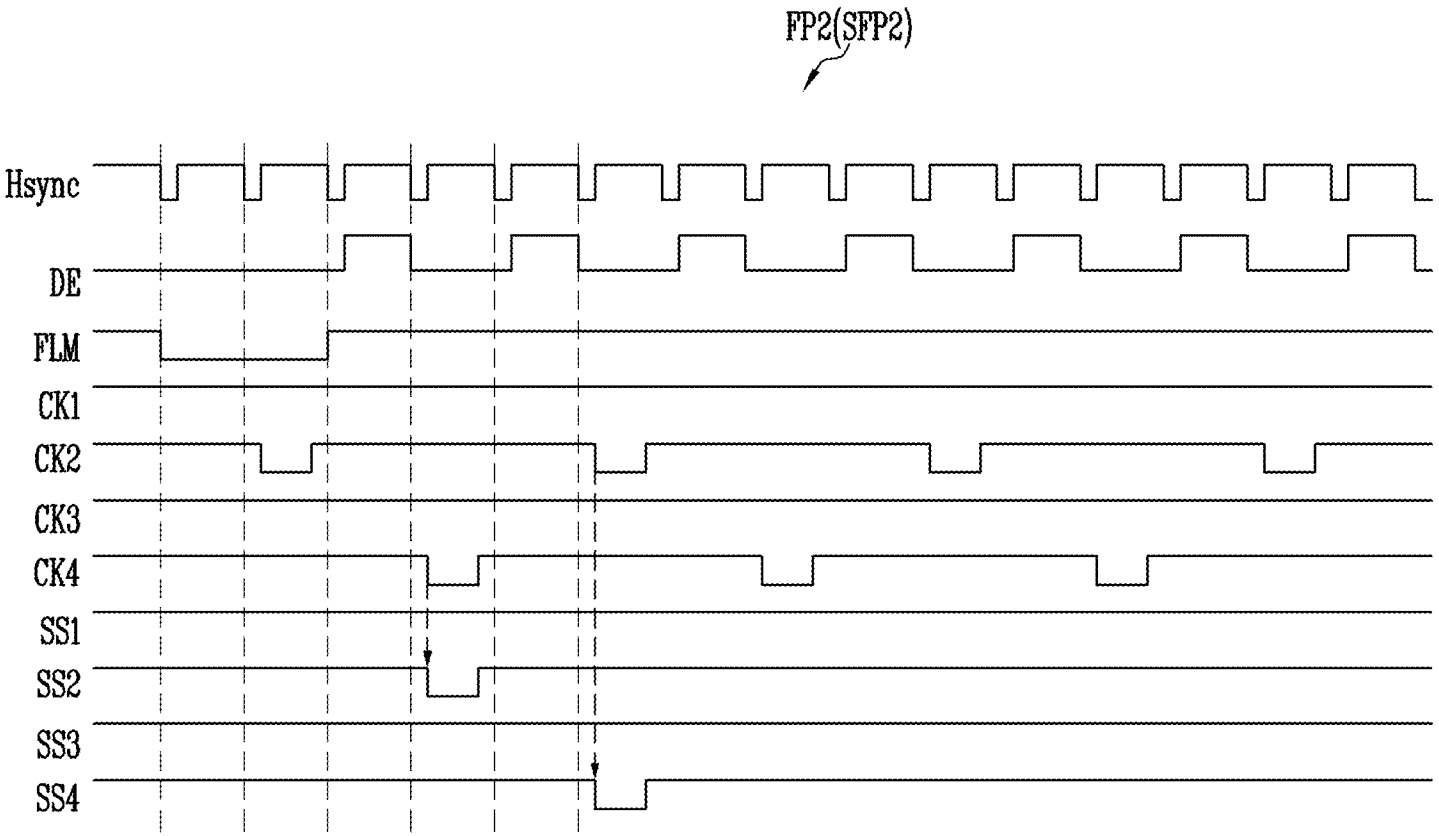

Referring to FIG. 9, control signals in the second sub-frame period SFP2 among the second frame period FP2 are shown as an example.

During the second sub-frame period SFP2, the second clock signals CK2 and CK4 of the turn-on level may be applied to the second clock lines CKL2 and CKL4, and the first clock signals CK1 and CK3 of the turn-off level may be maintained in the first clock lines CKL1 and CKL3. In the first frame period FP1 and the second sub-frame period SFP2, cycles in which the second clock signals CK2 and CK4 of the turn-on level are applied to the second clock lines CKL2 and CKL4 may be the same. In an embodiment, a cycle of each of the second clock signals CK2 and CK4 of the turn-on level may be four horizontal cycles 4H, for example.

In addition, the timing controller 11 may apply the scan start signal FLM of the turn-on level to the scan start line FLML. In this case, the length of the scan start signal FLM of the turn-on level may be set to overlap with the second clock signal CK2 of the turn-on level. In an embodiment, the length of the scan start signal FLM of the turn-on level may be two horizontal cycles 2H as shown, but may be set to one horizontal cycle 1H, for example.

During the second sub-frame period SFP2, the scan driver 13 may apply the second scan signals SS2, SS4, . . . of the turn-on level to the second scan lines SL2, SL4, . . . , and maintain the first scan signals SS1, SS3, . . . of the turn-off level in the first scan lines SL1, SL3, In the first frame period FP1 and the second sub-frame period SFP2, cycles in which the second scan signals SS2, SS4, . . . of the turn-on level are applied to the second scan lines SL2, SL4, . . . may be the same.

The data driver 12 may supply the data voltages to be synchronized with each of the second scan signals SS2, SS4, . . . of the turn-on level. In this case, since the data voltages do not need to be supplied to be synchronized with the first scan signals SS1, SS3, . . . , the cycle of the data enable signal DE of the turn-on level in the second sub-frame period SFP2 may be longer than the cycle of the data enable signal DE of the turn-on level in the first frame period FP1. Accordingly, since the cycle in which the data driver 12 changes the data voltages increases, there is an advantage that the dynamic power of the data driver 12 decreases.

FIGS. 10 to 13 are diagrams for explaining an embodiment of a first frame period and a second frame period according to the invention.

Figure 10:
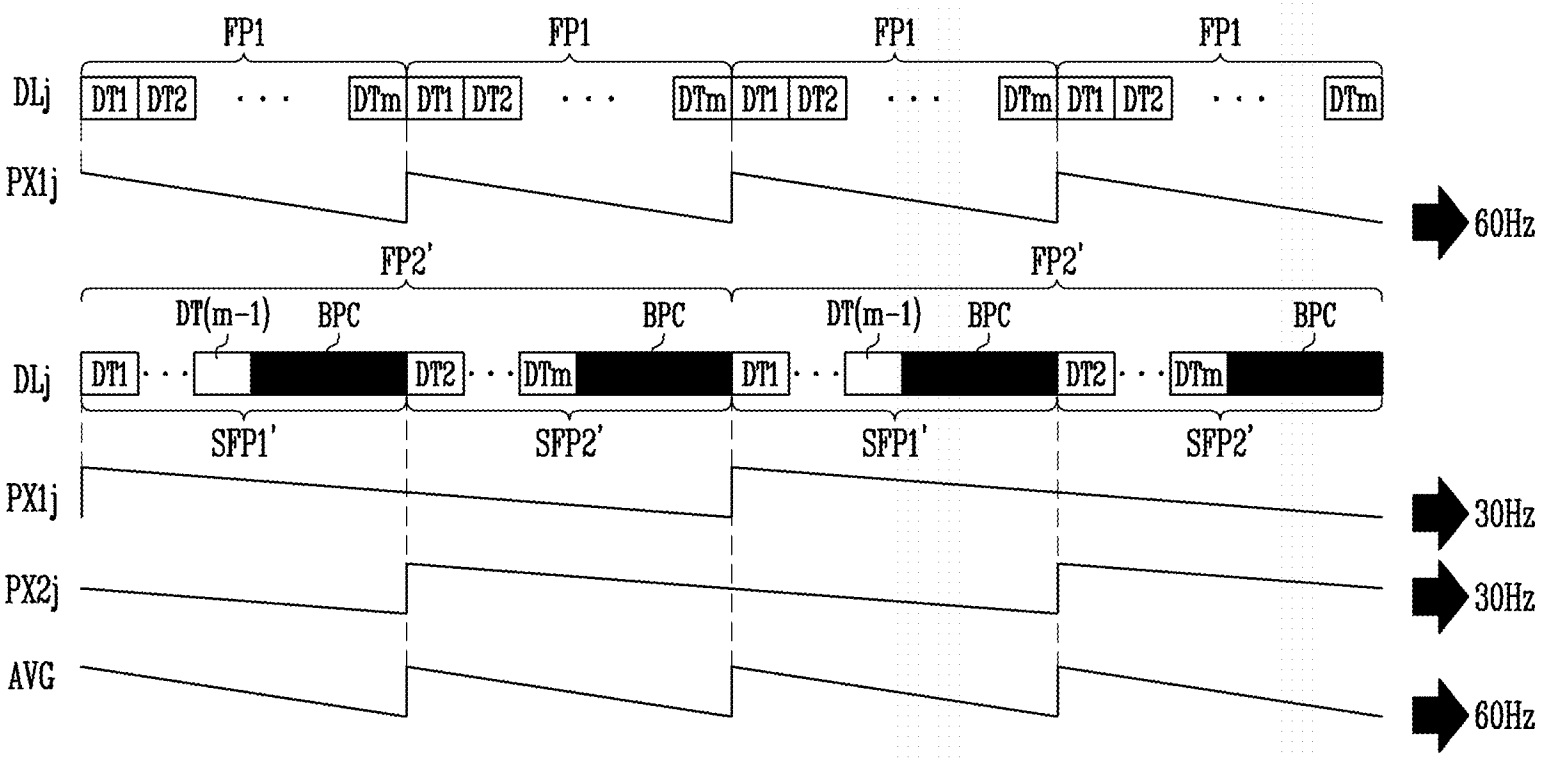
FIGS. 10 to 13 are diagrams for explaining another embodiment of a first frame period and a second frame period according to the invention.

In the embodiment of FIG. 10, a waveform of luminance and a driving method of a first pixel PX1*j* in a first frame period FP1 may be the same as those of FIG. 6. In addition, in the embodiment of FIG. 10, individual waveforms of luminance and a waveform AVG of an average luminance of first and second pixels PX1*j* and PX2*j* in a second frame period FP2' may be substantially the same as those of FIG. 6.

However, since each of a first sub-frame period SFP1' and a second sub-frame period SFP2' includes a data blank period BPC, a driving method in the second frame period FP2' of the embodiment of FIG. 10 may be different from the embodiment of FIG. 6. In an embodiment, the length of each of the first sub-frame period SFP1' and the second sub-frame period SFP2' may be the same as the length of each of the first sub-frame period SFP1 and the second sub-frame period SFP2, for example. In the embodiment of FIG. 10, the data driver 12 may supply the data voltages in a shorter cycle than that of FIG. 6. The data blank period BPC may be a remaining period after the data driver 12 supplies the data voltages in each of the first sub-frame period SFP1' and the second sub-frame period SFP2'. During the data blank period BPC, all or at least a portion (e.g., a gamma amplifier, a digital logic) of the data driver 12 may be powered off to reduce power consumption.

Figure 11:
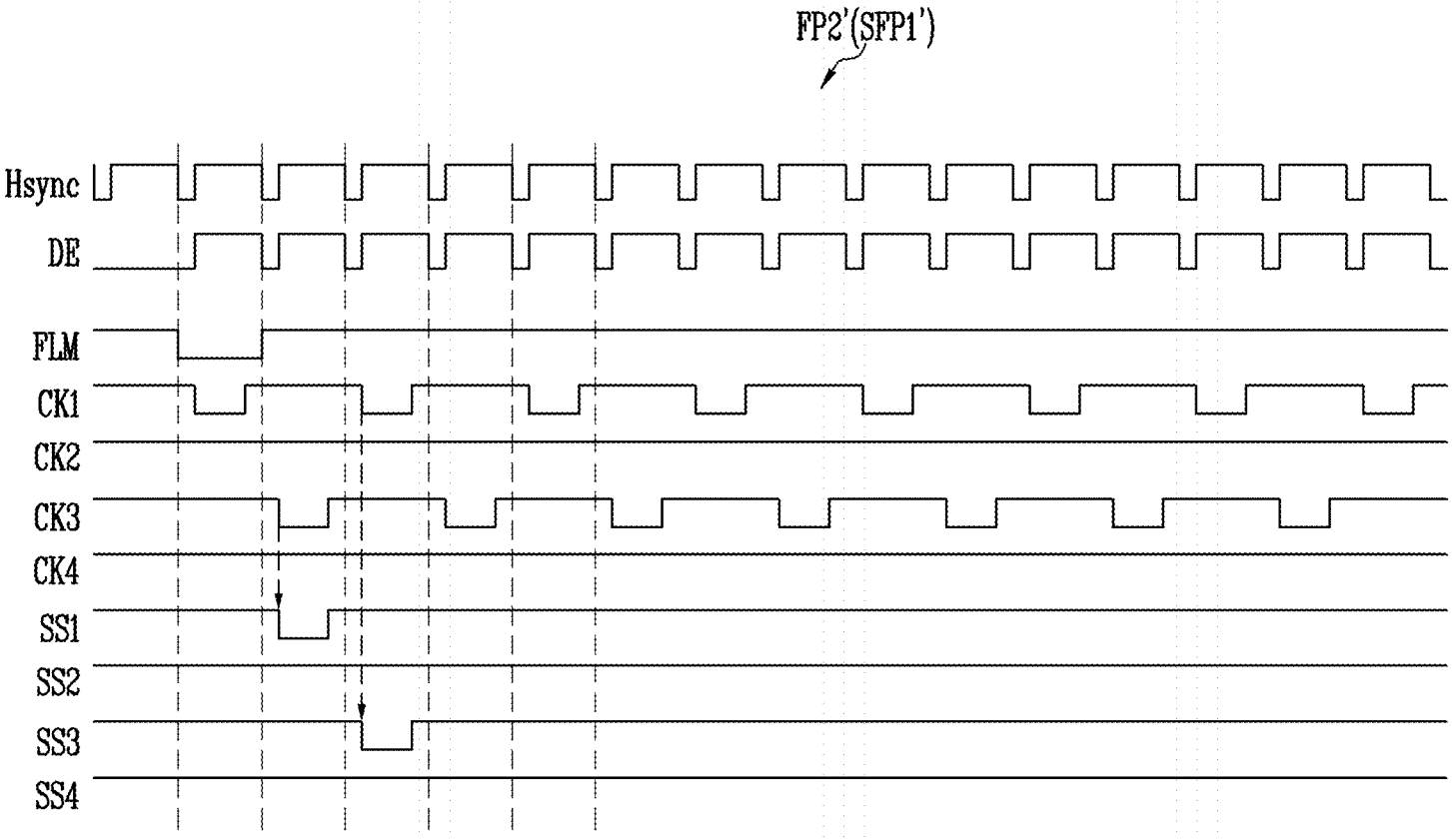

Referring to FIG. 11, control signals in the first sub-frame period SFP1' among the second frame period FP2' are shown as an example. Specifically, FIG. 11 shows the control signals in a period other than the data blank period BPC among the first sub-frame period SFP1'.

During the first sub-frame period SFP1', the timing controller 11 may apply the first clock signals CK1 and CK3 of the turn-on-level to the first clock lines CKL1 and CKL3, and maintain the second clock signals CK2 and CK4 of the turn-off level in the second clock lines CKL2 and CKL4. In the illustrated embodiment, a cycle in which the first clock signals CK1 and CK3 of the turn-on level are applied to the first clock lines CKL1 and CKL3 in the first sub-frame period SFP1' may be short than a cycle in which the first clock signals CK1 and CK3 of the turn-on level are applied in the first frame period FP1. In an embodiment, a cycle of each of the first clock signals CK1 and CK3 of the turn-on level may be two horizontal cycles 2H, for example.

The timing controller 11 may apply the scan start signal FLM of the turn-on level to the scan start line FLML. In this case, the length of the scan start signal FLM of the turn-on level may be set to overlap with the first clock signal CK1 of the turn-on level. In an embodiment, the length of the scan start signal FLM of the turn-on level may be set to one horizontal cycle 1H, for example.

During the first sub-frame period SFP1', the scan driver 13 may apply the scan signals SS1, SS3, . . . of the turn-on-level to the first scan lines SL1, SL3, . . . , and maintain the scan signals SS2, SS4, . . . of the turn-off level in the second scan lines SL2, SL4, . . . . A cycle in which the first scan signals SS1, SS3, . . . of the turn-on level are applied to the first scan lines SL1, SL3, . . . in the first sub-frame period SFP1' may be shorter than a cycle in which the first scan signals SS1, SS3, . . . of the turn-on level are applied in the first frame period FP1.

The data driver 12 may supply the data voltages to be synchronized with each of the first scan signals SS1, SS3, . . . of the turn-on level.

Figure 12:
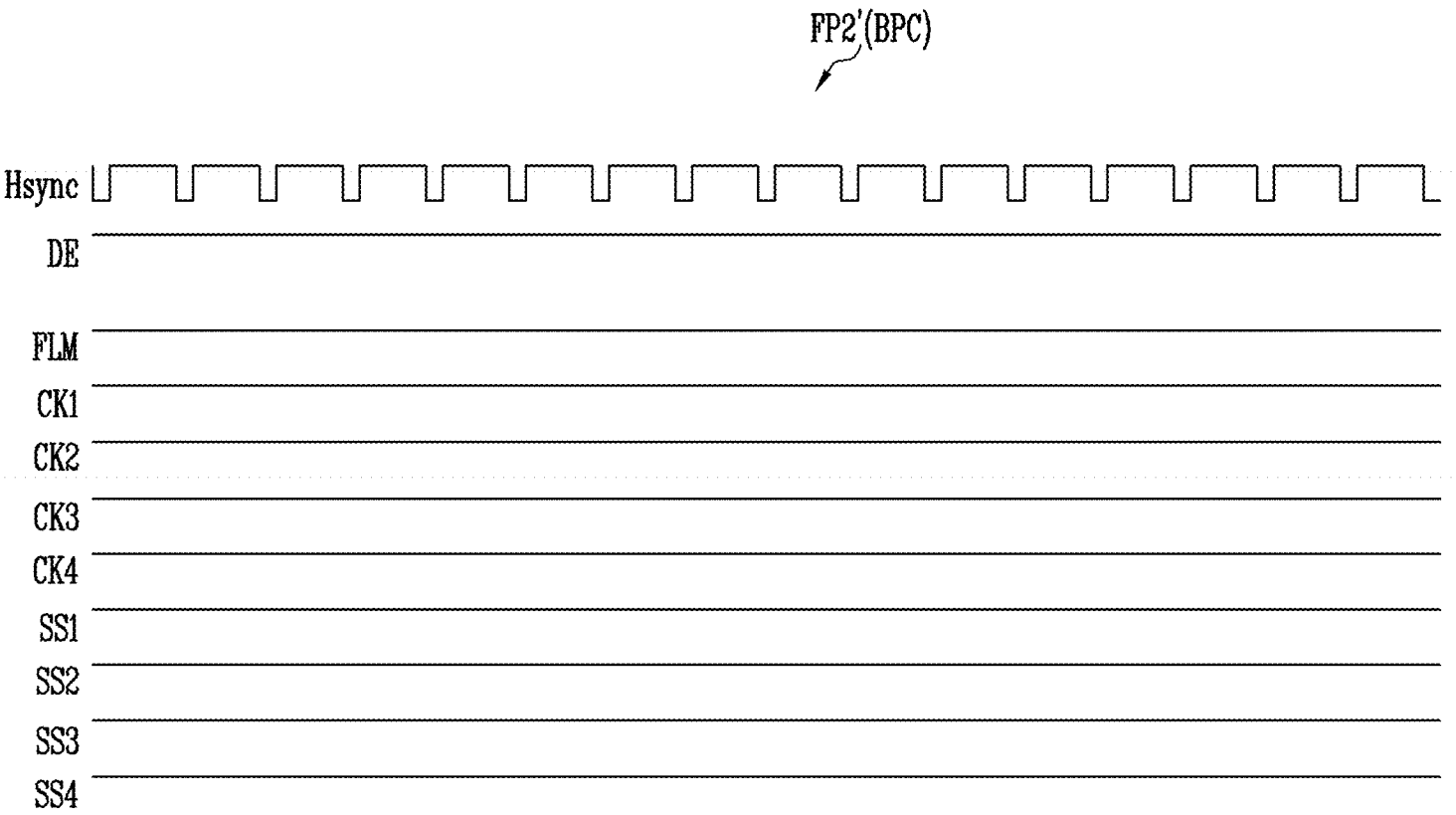

Referring to FIG. 12, control signals in the data blank period BPC among the second frame period FP2' are shown as an example. In the data blank period BPC, the clock signals CK1, CK2, CK3, and CK4 of the turn-off level, the scan signals SS1, SS2, SS3, SS4, . . . of the turn-off level, and the scan start signal FLM of the turn-off level may be maintained.

As described above, during the data blank period BPC, all or at least a portion (e.g., the gamma amplifier, the digital logic) of the data driver 12 may be powered off to reduce the power consumption.

Figure 13:
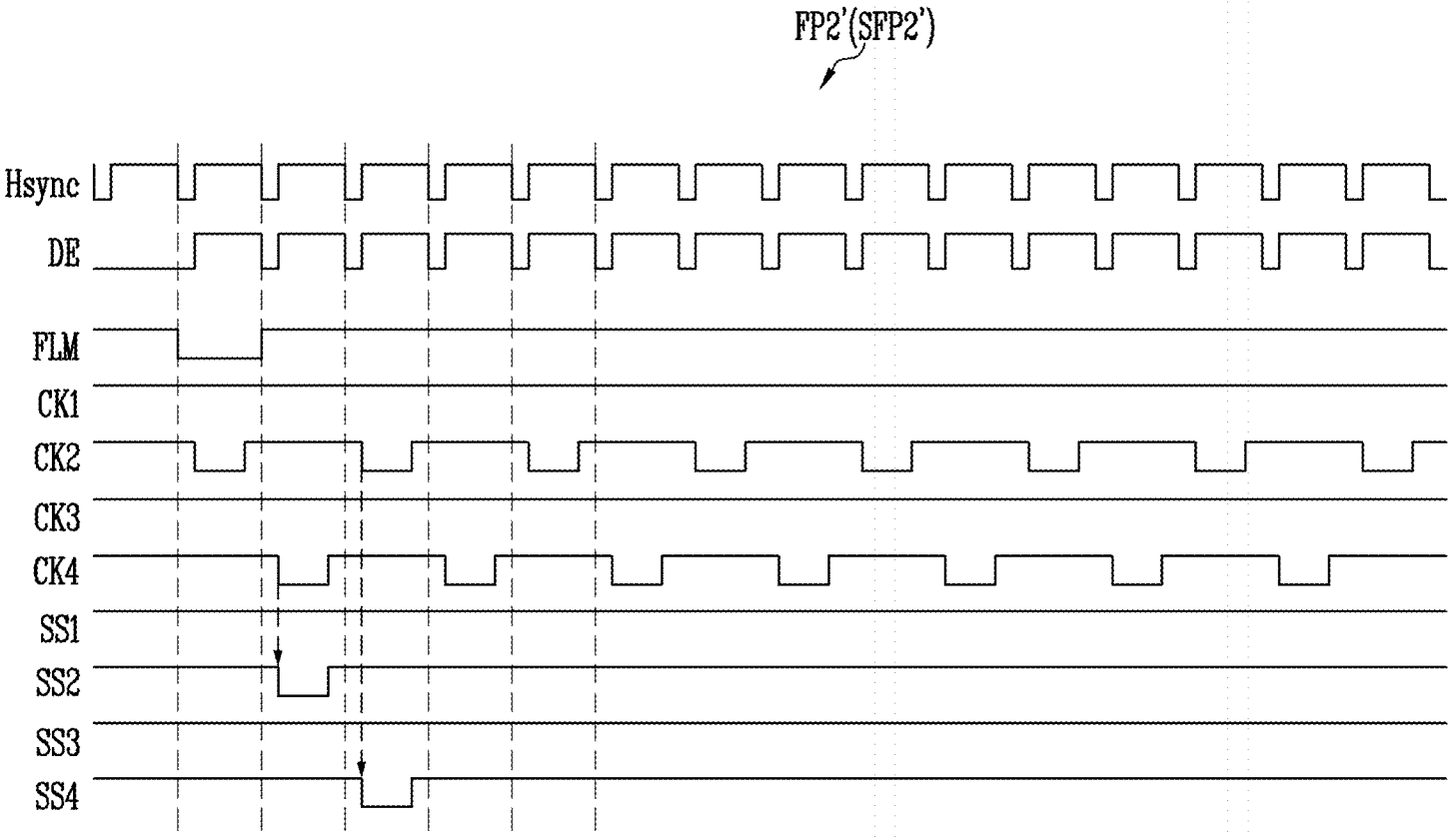

Referring to FIG. 13, control signals in the second sub-frame period SFP2' among the second frame period FP2' are shown as an example. Specifically, FIG. 13 shows the control signals in a period other than the data blank period BPC among the second sub-frame period SFP2'.

During the second sub-frame period SFP2', the second clock signals CK2 and CK4 of the turn-on level may be applied to the second clock lines CKL2 and CKL4, and the first clock signals CK1 and CK3 of the turn-off level may be maintained in the first clock lines CKL1 and CKL3. A cycle in which the second clock signals CK2 and CK4 of the turn-on level are applied to the second clock lines CKL2 and CKL4 in the second sub-frame period SFP2' may be shorter than a cycle in which the second clock signals CK2 and CK4 of the turn-on level are applied in the first frame period FP1. In an embodiment, a cycle of each of the second clock signals CK2 and CK4 of the turn-on level may be two horizontal cycles 2H, for example.

In addition, the timing controller 11 may apply the scan start signal FLM of the turn-on level to the scan start line FLML. In this case, the length of the scan start signal FLM of the turn-on level may be set to overlap with the second clock signal CK2 of the turn-on level. In an embodiment, the length of the scan start signal FLM of the turn-on level may be set to one horizontal cycle 1H, for example.

During the second sub-frame period SFP2', the scan driver 13 may apply the second scan signals SS2, SS4, . . . of the turn-on level to the second scan lines SL2, SL4, . . . , and maintain the first scan signals SS1, SS3, . . . of the turn-off level in the first scan lines SL1, SL3, . . . . A cycle in which the second scan signals SS2, SS4, . . . of the turn-on level are applied to the second scan lines SL2, SL4, . . . in the second sub-frame period SFP2' may be shorter than a cycle in which the second scan signals SS2, SS4, . . . of the turn-on level are applied in the first frame period FP1.

The data driver 12 may supply the data voltages to be synchronized with each of the second scan signals SS2, SS4, . . . of the turn-on level.

Figure 14:
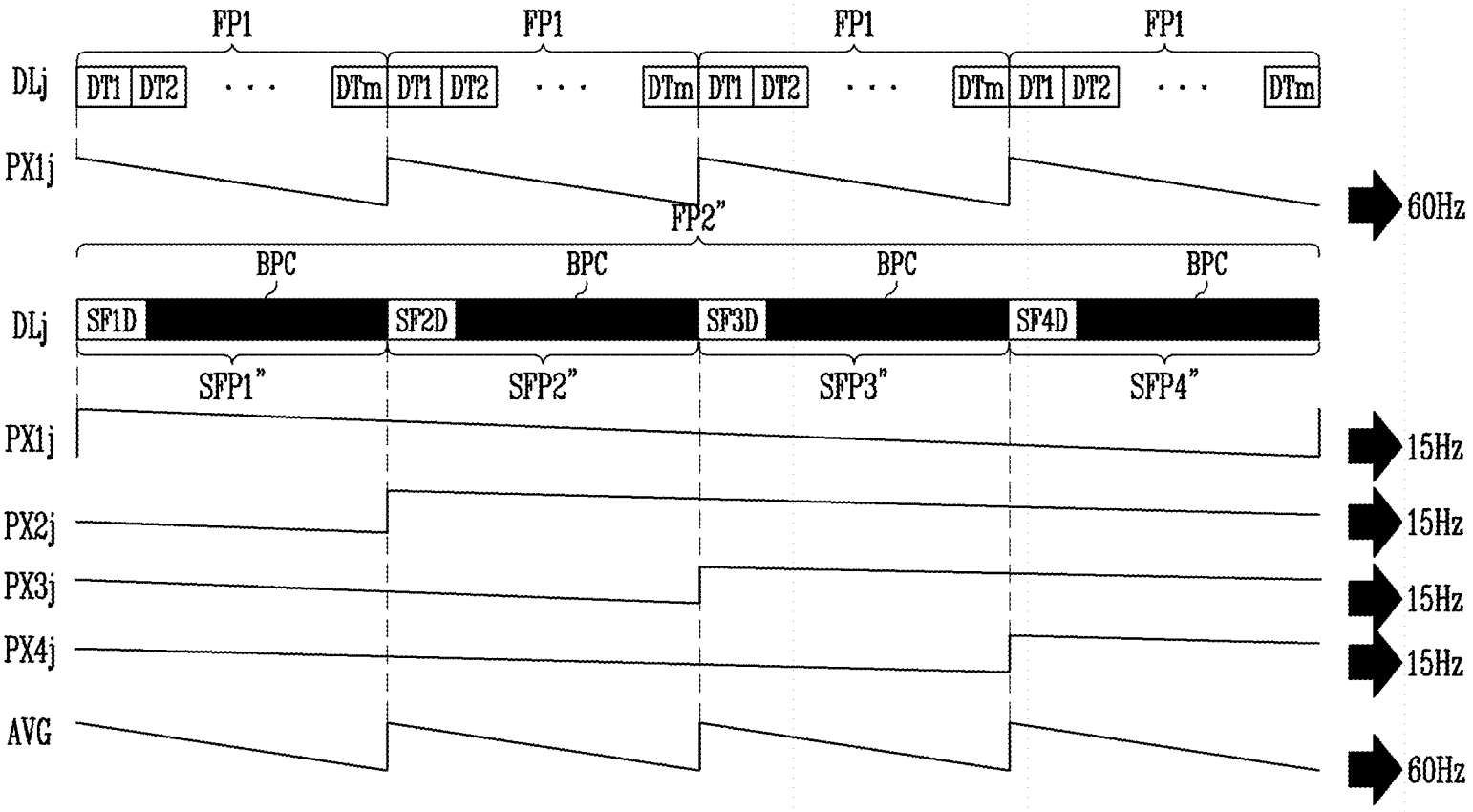
FIG. 14 is a diagram for explaining another embodiment of a first frame period and a second frame period according to the invention.

FIG. 14 is a diagram for explaining an embodiment of a first frame period and a second frame period in another embodiment of the invention.

In the embodiment of FIG. 14, a waveform of luminance and a driving method of a first pixel PX1*j* in a first frame period FP1 are the same as those of FIG. 6.

A driving method in a second frame period FP2" of FIG. 14 may be similar to that of FIG. 10, but may be different in that each second frame period FP2" includes four sub-frame periods SFP1", SFP2", SFP3", and SFP4". In an embodiment, the second frame period FP2" may be four times the first frame period FP1 and may be 1/15 second, for example. In an embodiment, each of the sub-frame periods SFP1", SFP2", SFP3", and SFP4" may be 1/60 second, for example.

In the embodiment of FIG. 10, two dots form one group, but in the embodiment of FIG. 14, there is a difference in that four adjacent dots form one group. The first pixel PX1*j* of a first dot may receive a data voltage SF1D in a first sub-frame period SFP1" and emit light with the highest luminance. A second pixel PX2*j* of a second dot may receive a data voltage SF2D in a second sub-frame period SFP2" and emit light with the highest luminance. A third pixel PX3*j* of a third dot may receive a data voltage SF3D in a third sub-frame period SFP3" and emit light with the highest luminance. A fourth pixel PX4*j* of a fourth dot may receive a data voltage SF4D in a fourth sub-frame period SFP4" and emit light with the highest luminance. Accordingly, even when each of the pixels PX1*j*, PX2*j*, PX3*j*, and PX4*j* emit light at a frequency of 15 Hz, a frequency of a waveform AVG of an average luminance of the group of the pixels PX1*j*, PX2*j*, PX3*j*, and PX4*j* may be recognized as 60 Hz.

Referring to FIGS. 10 and 14, the number of sub-frame periods SFP1" to SFP4" included in the second frame period FP2" may be variously set.

Figure 15:
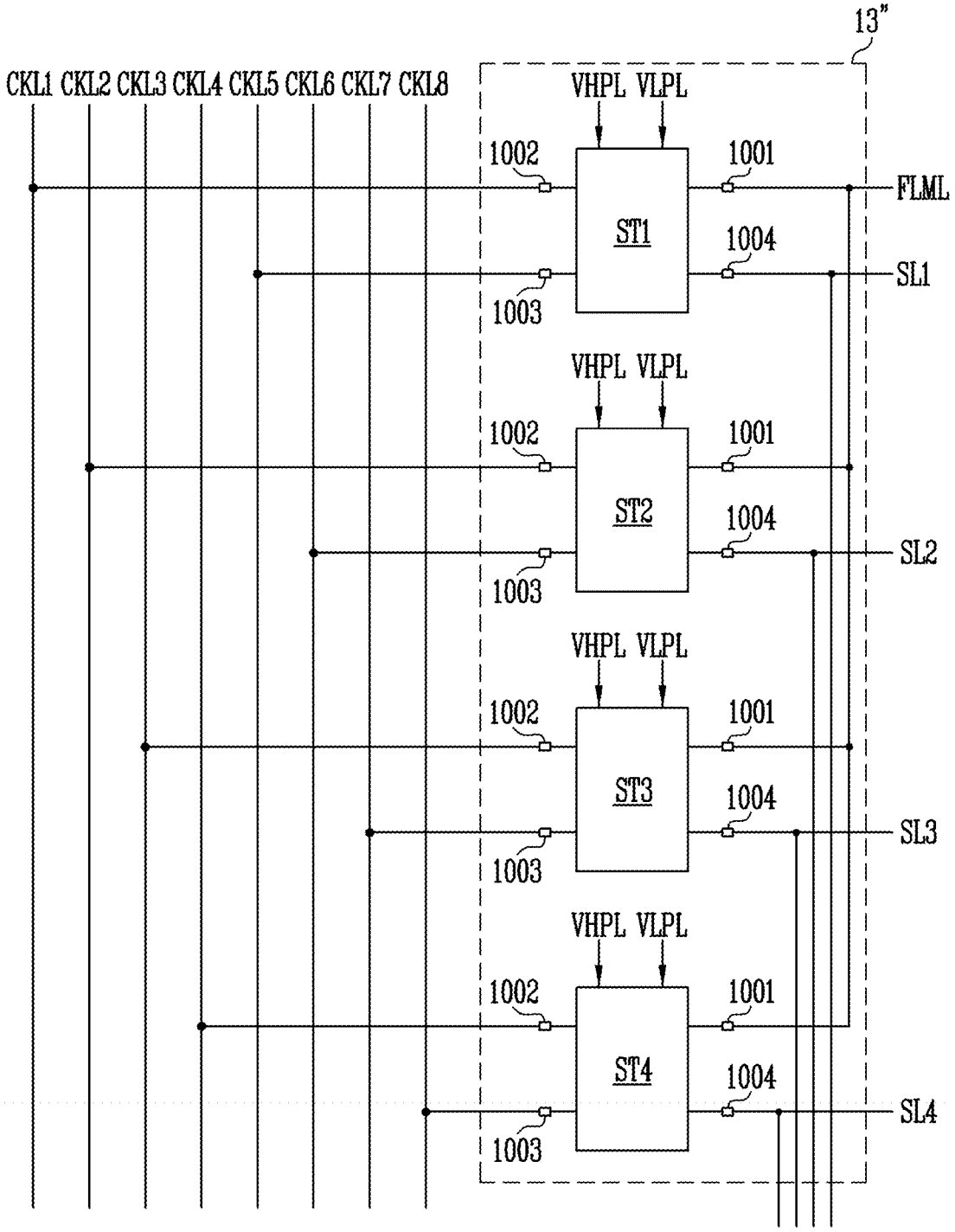
FIG. 15 is a diagram for explaining another embodiment of a scan driver according to the invention.

FIG. 15 is a diagram for explaining an embodiment of a scan driver according to the invention.

A scan driver 13" of FIG. 15 may be partially modified from the scan driver 13 of FIG. 3 to apply the driving method of FIG. 14. Internal circuit configurations of the scan driver 13" and the stages ST1 to ST4 of the scan driver 13 may be the same.

However, unlike the scan driver 13 of FIG. 3 divided into two stage groups (the odd-numbered stages and the even-numbered stages), the scan driver 13" of FIG. 15 may be divided into four stage groups. In an embodiment, a first stage group may include (4q+1)th stages ST1, . . . , and each of the stages ST1, . . . may be alternately connected to clock lines CKL1 and CKL5, where q may be a positive integer, for example. A second stage group may include (4q+2)th stages ST2, . . . , and each of the stages ST2, . . . may be alternately connected to clock lines CKL2 and CKL6. A third stage group may include (4q+3)th stages ST3, . . . , and each of the stages ST3, . . . may be alternately connected to clock lines CKL3 and CKL7. A fourth stage group may include (4q+4)th stages ST4, . . . , and each of the stages ST4, . . . may be alternately connected to clock lines CKL4 and CKL8.

The first input terminal 1001 of the first stages ST1, ST2, ST3, and ST4 of each stage group may be connected to the scan start line FLML. Since a driving method of the scan driver 13" is similar to that of the scan driver 13, duplicate descriptions will be omitted.

Figure 16:
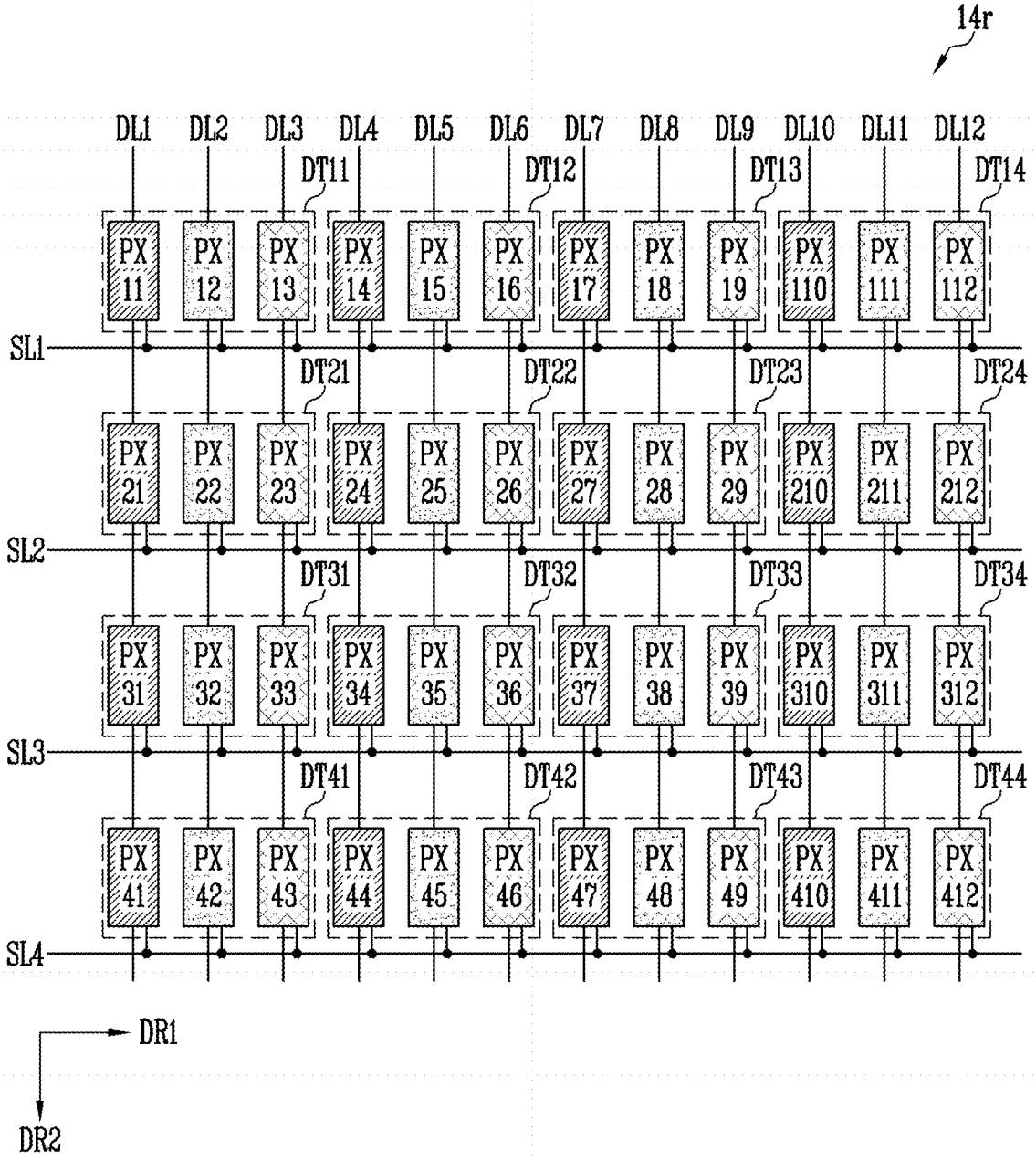
FIG. 16 is a diagram for explaining an embodiment of a pixel unit according to the invention.

FIG. 16 is a diagram for explaining an embodiment of a pixel unit according to the invention.

Referring to FIG. 16, a pixel unit 14*r* having an RGB stripe structure is shown as an example.

Each dot DT11, DT12, DT13, DT14, DT21, DT22, DT23, DT24, DT31, DT32, DT33, DT34, DT41, DT42, DT43, and DT44 may include a pixel of a first color, a pixel of a second color, and a pixel of a third color arranged in a first direction DR1. In this case, the first color, the second color, and the third color may be different from each other. In an embodiment, the first color may be red, the second color may be green, and the third color may be blue, for example.

Here, the color of the pixel may mean the color of light emitted by the light emitting diode LD of FIG. 2. Further, the position of the pixel is described based on the position of a surface from which the light is emitted from the light emitting diode LD.

Data lines DL1, DL2, DL3, DL4, DL5, DL6, DL7, DL8, DL9, DL10, D11, and DL12 may be connected to pixels of a single color. In an embodiment, data lines DL1, DL4, DL7, and DL10 may be connected to red pixels PXi1 (e.g., PX11, PX21, PX31, PX41), PXi4 (e.g., PX14, PX24, PX34, PX44), PXi7 (e.g., PX17, PX27, PX37, PX47), Pxi10 (e.g., PX110, PX210, PX310, and PX410), respectively. Data lines DL2, DL5, DL8, and DL11 may be connected to green pixels Pxi2 (e.g., PX12, PX22, PX32, PX42), Pxi5 (e.g., PX15, PX25, PX35, PX45), Pxi8 (e.g., PX18, PX28, PX38, PX48), and PXi11 (e.g., PX111, PX211, PX311, and PX411), respectively, for example. Also, data lines DL3, DL6, DL9, and DL12 may be connected to blue pixels Pxi3 (e.g., PX13, PX23, PX33, PX43), Pxi6 (e.g., PX16, PX26, PX36, PX46), Pxi9 (e.g., PX19, PX29, PX39, PX49), Pxi12 (e.g., PX112, PX212, PX312, and PX412), respectively, for example.

Dots DT11 to DT14 and DT31 to DT34 connected to first scan lines SL1 and SL3 may be disposed alternately with dots DT21 to DT24 and DT41 to DT44 connected to second scan lines SL2 and SL4 in a second direction DR2. However, in the embodiment of FIG. 16, the dots connected to the first scan lines SL1 and SL3 may not be disposed alternately with the dots connected to the second scan lines SL2 and SL4 in the first direction DR1. The first direction DR1 and the second direction DR2 may be orthogonal to each other.

Figure 17:
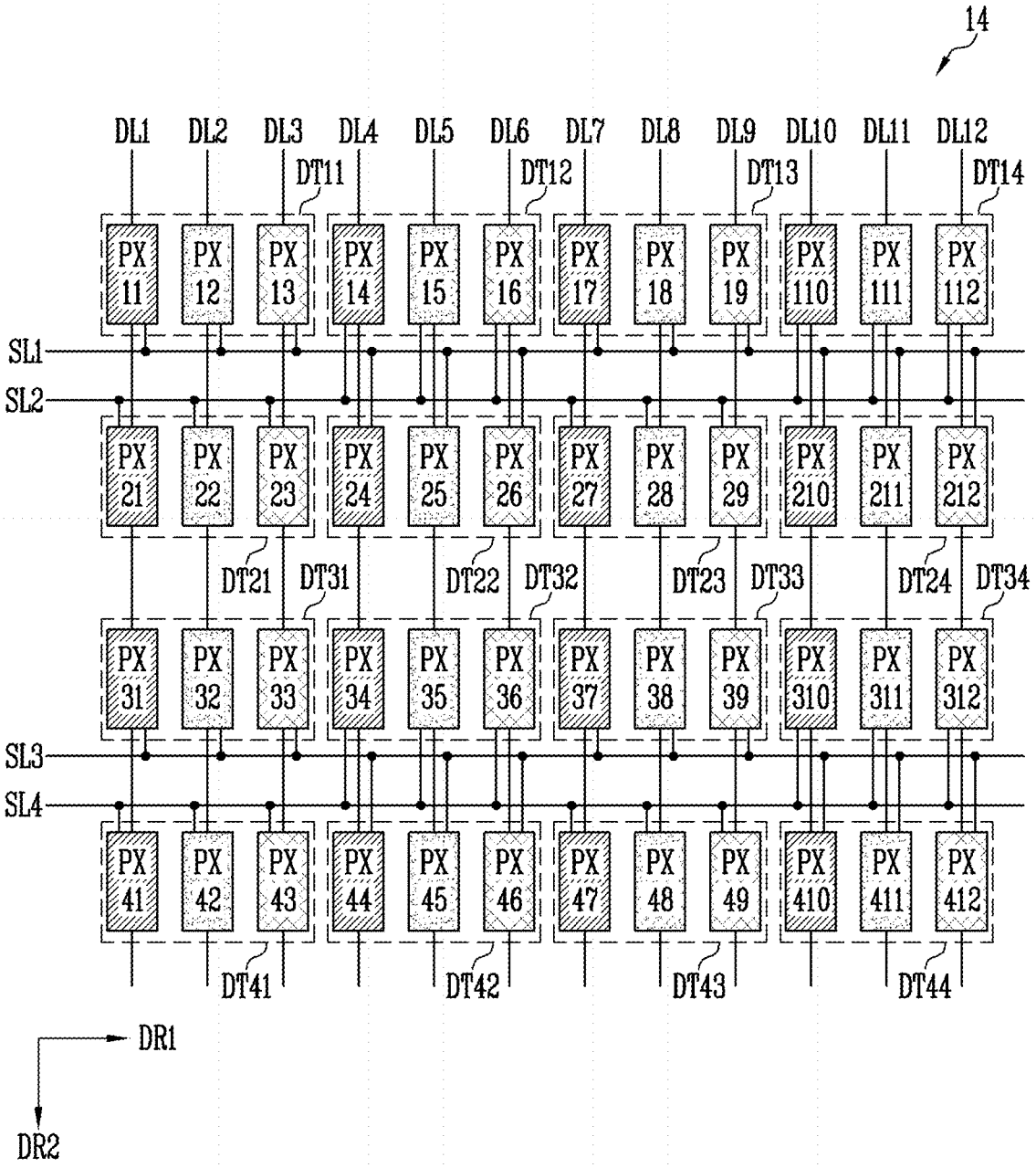
FIG. 17 is a diagram for explaining another embodiment of a pixel unit according to the invention.

FIG. 17 is a diagram for explaining an embodiment of a pixel unit according to the invention.

Referring to FIG. 17, a pixel unit 14 having the RGB stripe structure in another embodiment of the invention is shown. Since structures of dots DT11 to DT44 and data lines DL1 to DL12 are the same as those of FIG. 16, duplicate descriptions will be omitted.

In the illustrated embodiment, first dots DT11, DT22, DT13, DT24, DT31, DT42, DT33, and DT44 may be connected to first scan lines SL1 and SL3. Second dots DT21, DT12, DT23, DT14, DT41, DT32, DT43, and DT34 may be connected to second scan lines SL2 and SL4. In this case, the second dots DT21, DT12, DT23, DT14, DT41, DT32, DT43, and DT34 may be disposed alternately with the first dots DT11, DT22, DT13, DT24, DT31, DT42, DT33, and DT44 in the first direction DR1 and the second direction DR2. In an embodiment, when the first dots DT11, DT22, DT13, DT24, DT31, DT42, DT33, and DT44 are disposed corresponding to one color of boxes (e.g., white boxes) on a chessboard, the second dots DT21, DT12, DT23, DT14, DT41, DT32, DT43, and DT34 may be disposed corresponding to another color of boxes (e.g., black boxes) on the chessboard, for example.

When the pixel unit 14 of FIG. 17 is used, in each of the sub-frame periods SFP1 and SFP2 of the second display mode, a white portion and a black portion of a horizontal stripe pattern may be displayed in a balanced manner, thereby preventing the occurrence of flicker. In an embodiment, the horizontal stripe pattern may be a pattern in which odd-numbered pixel rows PX11 to PX112 and PX31 to PX312 display white, and even-numbered pixel rows PX21 to PX212 and PX41 to PX412 display black, for example.

Figure 18:
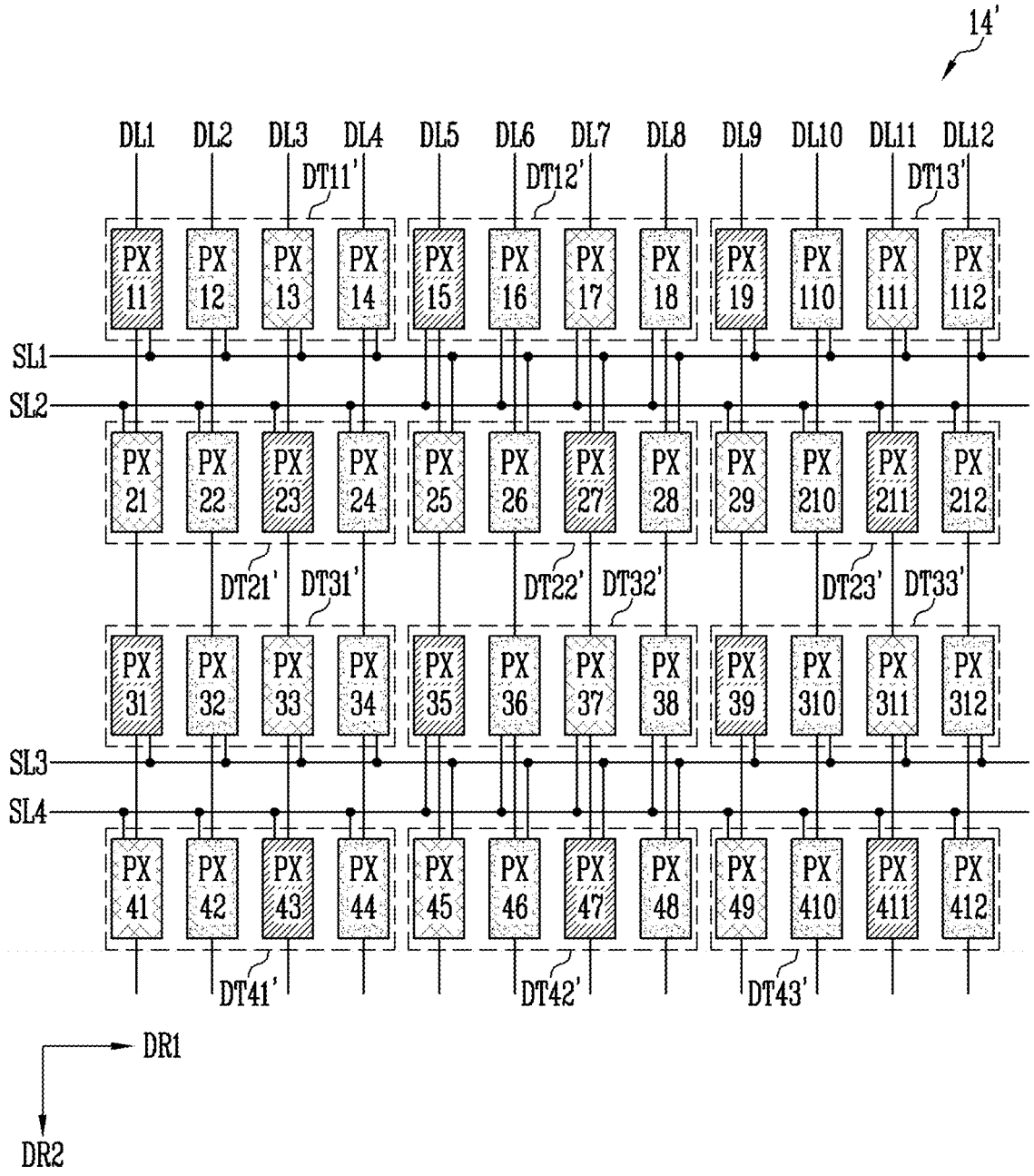
FIG. 18 is a diagram for explaining another embodiment of a pixel unit according to the invention.

FIG. 18 is a diagram for explaining an embodiment of a pixel unit in another embodiment of the invention.

Referring to FIG. 18, a pixel unit 14' having a pentile structure is shown as an example.

In the illustrated embodiment, first dots DT11', DT22', DT13', DT31', DT42', and DT33' may be connected to first scan lines SL1 and SL3. Second dots DT21', DT12', DT23', DT41', DT32', and DT43' may be connected to second scan lines SL2 and SL4. In this case, the second dots DT21', DT12', DT23', DT41', DT32', and DT43' may be disposed alternately with the first dots DT11', DT22', DT13', DT31', DT42', and DT33' in the first direction DR1 and the second direction DR2. In an embodiment, when the first dots DT11', DT22', DT13', DT31', DT42', and DT33' are disposed corresponding to the white boxes on the chessboard, the second dots DT21', DT12', DT23' DT41', DT32', and DT43' may be disposed corresponding to the black boxes on the chess board, for example.

One first dot DT11' of the first dots DT11', DT22', DT13', DT31', DT42', and DT33' may include a pixel PX11 of a first color, a pixel PX12 of a second color, a pixel PX13 of a third color, and a pixel PX14 of the second color arranged in the first direction DR1.

A second dot DT21' disposed in the second direction DR2 from the first dot DT11' may include a pixel PX21 of the third color, a pixel PX22 of the second color, a pixel PX23 of the first color, and a pixel PX24 of the second color arranged in the first direction DR1.

A second dot DT12' disposed in the first direction DR1 from the first dot DT11' may include a pixel PX15 of the first color, a pixel PX16 of the second color, a pixel PX17 of the third color, and a pixel PX18 of the second color arranged in the first direction DR1.

Another first dot DT22' of the first dots DT11', DT22', DT13', DT31', DT42', and DT33' may include a pixel PX25 of the third color, a pixel PX26 of the second color, a pixel PX27 of the first color, and a pixel PX28 of the second color arranged in the first direction DR1.

A second dot DT32' disposed in the second direction DR2 from a first dot DT22' may include a pixel PX35 of the first color, a pixel PX36 of the second color, a pixel PX37 of the third color, and a pixel PX38 of the second color arranged in the first direction DR1.

A second dot DT23' disposed in the first direction DR1 from the first dot DT22' may include a pixel PX29 of the third color, a pixel PX210 of the second color, a pixel PX211 of the first color, and a pixel PX212 of the second color arranged in the first direction DR1.

Each of the first data lines DL1, DL3, DL5, DL7, DL9, and DL11 among the data lines DL1 to DL12 may be alternately connected to the pixels of the first color and the third color. Each of the second data lines DL2, DL4, DL6, DL8, DL10, and DL12 among the data lines DL1 to DL12 may be connected to the pixels of the second color. The first data lines DL1, DL3, DL5, DL7, DL9, and DL11 may be disposed alternately with the second data lines DL2, DL4, DL6, DL8, DL10, and DL12 in the first direction DR1. The data lines DL1 to DL12 may extend substantially in the second direction DR2.

Even when the pixel unit 14' of FIG. 18 is used, the same effect as that of FIG. 17 may be obtained. That is, when the pixel unit 14' of FIG. 18 is used, in each of the sub-frame periods SFP1 and SFP2 of the second display mode, the white portion and the black portion of the horizontal stripe pattern may be displayed in a balanced manner, thereby preventing the occurrence of flicker.

The display device according to the invention may prevent visual recognition of the flicker when a display frequency is switched from the high frequency to the low frequency.

The display device according to the invention may prevent the flicker from occurring when a specific pattern is displayed during low frequency driving.

The drawings referred to heretofore and the detailed description of the invention described above are merely illustrative of the invention. It is to be understood that the invention has been disclosed for illustrative purposes only and is not intended to limit the meaning or scope of the invention as set forth in the claims. Therefore, those skilled in the art will appreciate that various modifications and equivalent embodiments are possible without departing from the scope of the invention. Accordingly, the true scope of the invention should be determined by the technical idea of the appended claims.

What is claimed is:

1. A display device comprising:

first dots connected to first scan lines and not connected to second scan lines;

second dots connected to the second scan lines, not connected to the first scan lines, and alternately disposed with the first dots in a first direction and a second direction different from the first direction;

a scan driver including a plurality of first stages respectively connected to the first scan lines and a plurality of second stages respectively connected to the second scan lines; and a data driver connected to the first dots and the second dots through data lines, wherein the plurality of first stages is connected to first clock lines, wherein the plurality of second stages is connected to second clock lines different from the first clock lines, wherein first stages of the plurality of the first stages except a first start stage of the plurality of first stages are respectively connected to corresponding first scan lines of corresponding previous first stages among the first scan lines of the plurality of first stages, and wherein second stages of the plurality of the second stages except a second start stage of the plurality of second stages are respectively connected to corresponding second scan lines of corresponding previous second stages among the second scan lines of the plurality of second stages.

2. The display device of claim 1, wherein each of the first dots and the second dots includes a pixel of a first color, a pixel of a second color, and a pixel of a third color arranged in the first direction, and wherein the first color, the second color, and the third color are different from each other.

3. The display device of claim 2, wherein each of the data lines is connected to pixels of a single color.

4. The display device of claim 1, wherein one first dot of the first dots includes a pixel of a first color, a pixel of a second color, a pixel of a third color, and a pixel of the second color arranged in the first direction, wherein one second dot of the second dots disposed in the second direction from the one first dot of the first dots includes a pixel of the third color, a pixel of the second color, a pixel of the first color, and a pixel of the second color arranged in the first direction, and wherein the first color, the second color, and the third color are different from each other.

5. The display device of claim 4, wherein one data line of the data lines is alternately connected with the pixels of the first color and the third color, and wherein another data line of the data lines is connected to the pixels of the second color.

6. The display device of claim 1, wherein the first start stage among the plurality of first stages and the second start stage among the plurality of second stages are connected to a same scan start line.

7. The display device of claim 6, wherein during each first frame period, the scan driver alternately applies scan signals of a turn-on level to the first scan lines and the second scan lines.

8. The display device of claim 7, wherein during a first sub-frame period among each second frame period, the scan driver applies the scan signals of the turn-on level to the first scan lines, and maintains the scan signals of a turn-off level in the second scan lines, and wherein during a second sub-frame period among the each second frame period, the scan driver applies the scan signals of the turn-on level to the second scan lines, and maintains the scan signals of the turn-off level in the first scan lines.

9. The display device of claim 8, wherein the second frame period is longer than the first frame period.

10. The display device of claim 8, wherein during the first frame period, first clock signals of a turn-on level are applied to the first clock lines, and second clock signals of the turn-on level are applied to the second clock lines, and wherein the first clock signals and the second clock signals have different phases.

11. The display device of claim 10, wherein during the first sub-frame period, the first clock signals of the turn-on level are applied to the first clock lines, and the second clock signals of the turn-off level are maintained in the second clock lines, and wherein during the second sub-frame period, the second clock signals of the turn-on level are applied to the second clock lines, and the first clock signals of the turn-off level are maintained in the first clock lines.

12. The display device of claim 11, wherein in the first frame period and the first sub-frame period, cycles in which the first clock signals of the turn-on level are applied to the first clock lines are identical to each other.

13. The display device of claim 12, wherein in the first frame period and the second sub-frame period, cycles in which the second clock signals of the turn-on level are applied to the second clock lines are identical to each other.

14. The display device of claim 13, wherein in the first frame period and the first sub-frame period, cycles in which first scan signals of the turn-on level are applied to the first scan lines are identical to each other.

15. The display device of claim 14, wherein in the first frame period and the second sub-frame period, cycles in which second scan signals of the turn-on level are applied to the second scan lines are identical to each other.

16. The display device of claim 11, wherein a cycle in which the first clock signals of the turn-on level are applied to the first clock lines in the first sub-frame period is shorter than a cycle in which the first clock signals of the turn-on level are applied in the first frame period.

17. The display device of claim 16, wherein a cycle in which the second clock signals of the turn-on level are applied to the second clock lines in the second sub-frame period is shorter than a cycle in which the second clock signals of the turn-on level are applied in the first frame period.

18. The display device of claim 17, wherein a cycle in which first scan signals of the turn-on level are applied to the first scan lines in the first sub-frame period is shorter than a cycle in which the first scan signals of the turn-on level are applied in the first frame period.

19. The display device of claim 18, wherein a cycle in which second scan signals of the turn-on level are applied to the second scan lines in the second sub-frame period is shorter than a cycle in which the second scan signals of the turn-on level are applied in the first frame period.

20. The display device of claim 17, wherein during at least some of the first sub-frame period and the second sub-frame period, the data driver is powered off.

* * * * *